US006892036B2

(12) United States Patent
Ito

(10) Patent No.: US 6,892,036 B2
(45) Date of Patent: May 10, 2005

(54) TONER CARTRIDGE HAVING A TONER AGITATOR AND A RECIPROCALLY MOVING MEMBER COUPLED TO THE AGITATOR, AND AN IMAGE FORMING APPARATUS

(75) Inventor: Junichi Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 8 days.

(21) Appl. No.: 10/212,123

(22) Filed: Aug. 6, 2002

(65) Prior Publication Data

US 2003/0031479 A1 Feb. 13, 2003

(30) Foreign Application Priority Data

Aug. 7, 2001 (JP) ..... 2001-239001

(51) Int. Cl.[7] ..... G03G 15/08
(52) U.S. Cl. ..... 399/27; 399/254; 399/263
(58) Field of Search ..... 399/262, 263, 399/27, 61, 63, 254; 222/DIG. 1; 118/692, 694

(56) References Cited

U.S. PATENT DOCUMENTS 4,592,642 A * 6/1986 Imaizumi et al. ..... 399/27
5,287,151 A * 2/1994 Sugiyama ..... 399/258
5,790,917 A * 8/1998 Takura et al. ..... 399/27
5,923,918 A * 7/1999 Nakagawa et al. ..... 399/27
6,100,601 A * 8/2000 Baker et al. ..... 73/290 V
6,415,126 B2 * 7/2002 Kaneshige et al. ..... 399/256
6,510,291 B2 * 1/2003 Campbell et al. ..... 399/27
6,546,213 B2 * 4/2003 Ito et al. ..... 399/27

FOREIGN PATENT DOCUMENTS

JP 11119537 A * 4/1999 ..... G03G/15/08

* cited by examiner

*Primary Examiner*—Robert Beatty
(74) *Attorney, Agent, or Firm*—Rabin & Berdo, P.C.

(57) ABSTRACT

A toner cartridge has a toner-agitating member that agitates the toner to be supplied to a developing unit. The toner cartridge has at least a part of a detecting mechanism that transmits the motion of the agitating member to detect an amount of the remaining toner in the toner cartridge. The detecting mechanism has a sensor rod. The sensor rod has one end that rotatably engages the agitating member and the other end to which a detector is attached. At least a part of the motion-transmitting section is made of a material that when the part receives a pressure greater than a predetermined value, the part absorbs the pressure.

20 Claims, 22 Drawing Sheets

TONER LOW

TONER FULL

TONER CARTRIDGE HAVING A TONER AGITATOR AND A RECIPROCALLY MOVING MEMBER COUPLED TO THE AGITATOR, AND AN IMAGE FORMING APPARATUS

BACKGROUND OF THE INVENTION

1. Field of the Invention

The present invention relates to an image forming apparatus such as an electrophotographic recording apparatus and a copying machine, a print process cartridge that is removably attached to an image forming apparatus, and a toner cartridge that is removably attached to a print process cartridge.

2. Description of the Related Art

One conventional electrophotographic recording apparatus is an electrophotography color image recording apparatus and incorporates a print medium transporting member and a plurality of image-forming sections. The print medium-transporting member transports a print medium to the image forming sections. The image forming sections are disposed in a direction in which the print medium is transported. The image-forming sections form toner images of corresponding colors. Each of the image forming sections has a print process cartridge, an exposing unit, and a transfer unit. The transfer unit transfers a toner image formed in the print process cartridge. The print process cartridge is removably attached to the image forming section. The print process cartridge includes a charging unit, a photoconductor, a developing unit, a cleaning unit, a toner cartridge, and a drive force-transmitting section. The drive force-transmitting section transmits a drive force for driving the charging unit, photoconductor, and developing unit. The charging unit charges the photoconductor. The exposing unit illuminates the charged surface of the photoconductor. Then, the exposing unit forms an electrostatic latent image on the surface of the photoconductor in accordance with print data. The developing unit applies toner to the electrostatic latent image on the photoconductor to develop the latent image into a toner image. The cleaning unit scratches off the toner that has failed to be transferred and remained on the photoconductor. The toner cartridge supplies toner to the developing unit. The toner cartridge is removably attached to the print process cartridge. The developing unit includes a developing roller and a toner-supplying roller. The developing roller is in pressure contact with the surface of the photoconductor. The developing roller applies the toner to the electrostatic latent image on the photoconductor to develop the electrostatic latent image into a toner image.

The toner cartridge includes an opening, an agitator, and a remaining-toner detecting mechanism, and holds toner therein. The toner is supplied through the opening from the toner cartridge to the toner supplying roller and developing roller. The toner-supplying roller supplies the toner to the developing roller. The agitator agitates the toner before supplying the toner to the developing unit. The agitator has an agitating shaft. The agitating shaft is linked to a remaining toner detecting mechanism. The remaining toner detecting mechanism detects an amount of the remaining toner from the operation of the agitator. A drive source rotates at a predetermined speed. The agitating shaft is supported by bearings. The agitating shaft rotates in such a way that the agitating shaft can be connected to and disconnected from the drive force transmitting section.

When the agitating shaft rotates, it is subject to a load of toner, which depends on an amount of remaining amount of toner. The time required for the agitating shaft to make one complete rotation depends on the load of toner. When the agitating shaft passes its top dead center, the agitating shaft drops due to its own weight toward the top surface of the pile of toner. When the amount of remaining toner is large, the agitating shaft falls through a short distance before it lands on the pile f toner. When the amount of remaining toner is small, the agitating shaft falls through a long distance before it lands on the pile of toner. The toner remaining detecting mechanism detects the amount of remaining toner by comparing the time required for the drive source to make one complete rotation with the time required for the agitating shaft to make one complete rotation.

A fine shaft is coupled to the agitating shaft and transmits the motion of the agitating shaft. The guide section constraints the motion of the tip portion of the sensor shaft to the reciprocating motion of the fine shaft. The toner cartridge is stored and is subject to mechanical vibration during transportation. Toner may be clumped in the toner cartridge due to mechanical vibration and long storage. Therefore, printing may be performed when a lump of toner is in the path of the tip portion of the sensor shaft. The toner cartridge allows the agitator to operate when printing is performed. The fine shaft operates to follow the motion of the agitator. The movement of the fine shaft is interfered with a lump of toner, so that the fine shaft is subject to a load due to the lump of toner. The bearing of the agitating shaft receives an increased load when the load on the fine shaft increases. When a load is exerted on the fine shaft, the rod may be deformed and sometimes may not regain its original shape. If the permanently deformed fine shaft is operated, the fine shaft may collide with surroundings or its mounting members.

Due to collision of the fine shaft with mounting members and the surroundings during the mounting operation, the fine shaft receives larger loads. The load on the fine shaft is transmitted to the agitating shaft. The load of the agitating shaft is transmitted to the drive source that drives the agitating shaft. Thus, an increased load may prevent the drive source from driving the agitating shaft normally.

If the agitating shaft cannot rotate normally, it cannot agitate the clumped toner normally. If the toner is not normally agitated, the toner cartridge cannot supply the toner normally to the developing unit. If a sufficient amount of toner is not supplied to the developing unit, an electrostatic latent image cannot be developed into a toner image normally. Because a toner image is no normally formed in the print process cartridge, the image forming sections fail to conduct normal printing.

SUMMARY OF THE INVENTION

An object of the invention is to provide a toner cartridge in which even if a load is exerted on the fine shaft and agitating shaft, a printing operation can be performed normally.

Another object of the invention is to provide a print process cartridge to which a toner cartridge can be removably attached, the toner cartridge being such that even if a load is exerted on the fine shaft and agitating shaft, a printing operation can be performed normally.

A still another object of the invention to provide an image forming section to which a toner cartridge can be removably attached, the print process cartridge being such that even if a load is exerted on the fine shaft and agitating shaft, a printing operation can be performed normally.

In order to achieve the aforementioned objects, a toner cartridge according to the present invention is of the following configuration.

A toner cartridge includes a toner chamber, a motion-transmitting section, and at least a part of a remaining toner detecting mechanism. The toner chamber holds toner therein which in turn is supplied to the developing unit. At least a part of the motion transmitting section includes a member that when pressures greater than a predetermined value are applied to the member, the member absorbs the applied pressure.

A print process cartridge according to the invention includes a drive force-transmitting section that transmits a drive force from the drive source to the toner cartridge. The charging unit charges a photoconductor. The exposing unit illuminates the surface of the charged photoconductor. The exposing unit forms an electrostatic latent image in accordance with print data. The developing unit develops the electrostatic latent image with toner into a toner image. The cleaning section scratches residual toner that has failed to be transferred and remained on the photoconductor. The toner cartridge is removably attached to the print process cartridge.

In order to achieve the aforementioned object, an image forming section according to the invention is of the following configuration. The image forming section includes a print process cartridge, a transfer section, a medium-transporting member, and a part of a remaining toner-detecting mechanism. The transfer section transfers the toner image formed in the print process cartridge onto a print medium. The remaining toner-detecting mechanism includes a detecting mechanism that detects the operation of the fine shaft, the detecting mechanism being provided on the main body of the image forming section.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Figure 1:
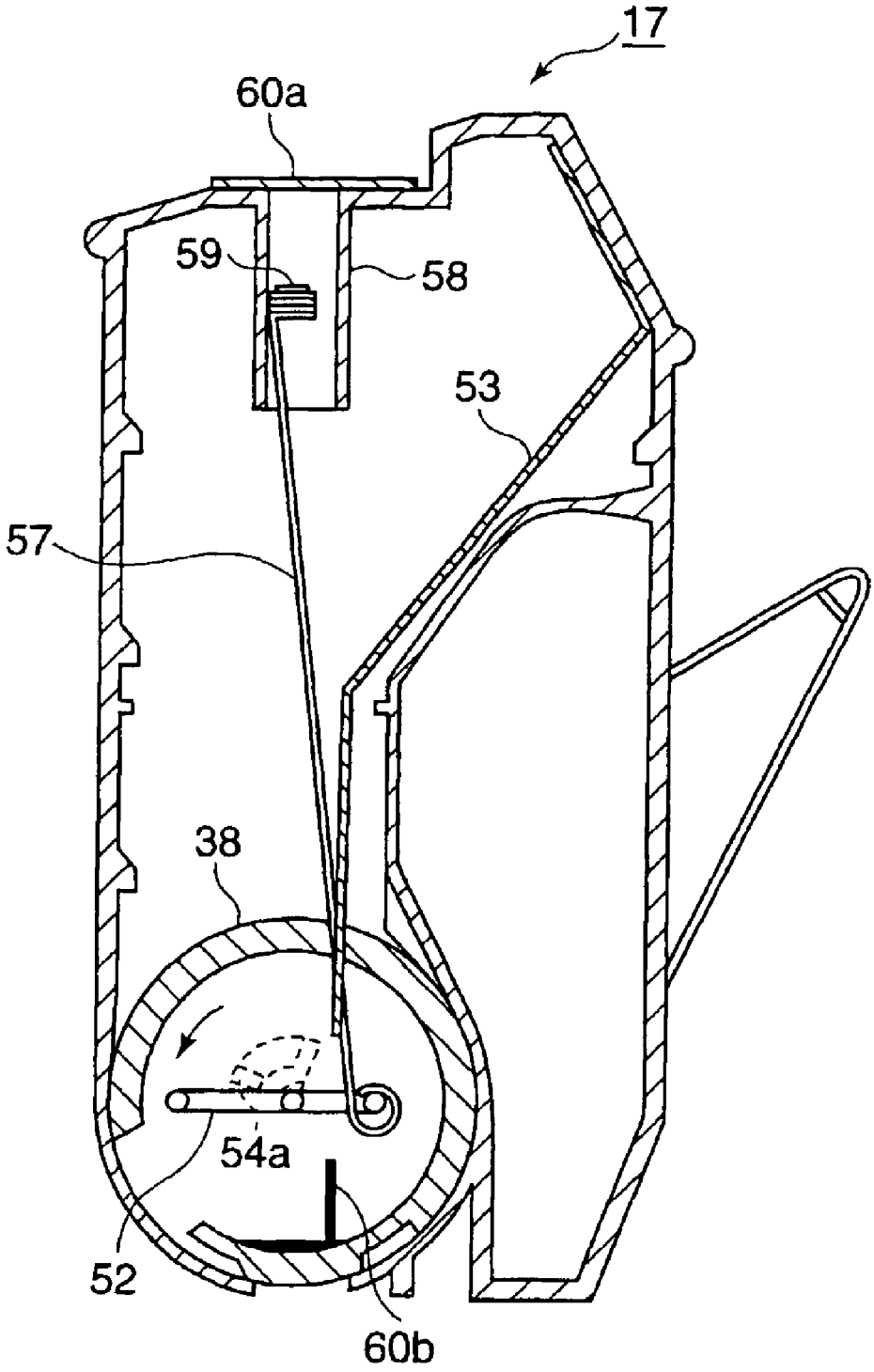
FIG. 1 is a perspective view of a toner cartridge in FIG. 11 taken along line I—I of FIG. 11.

Embodiments of the invention will be described with reference to the accompanying drawings. Like elements have been given like reference numerals throughout the drawings.

First Embodiment

Figure 2:
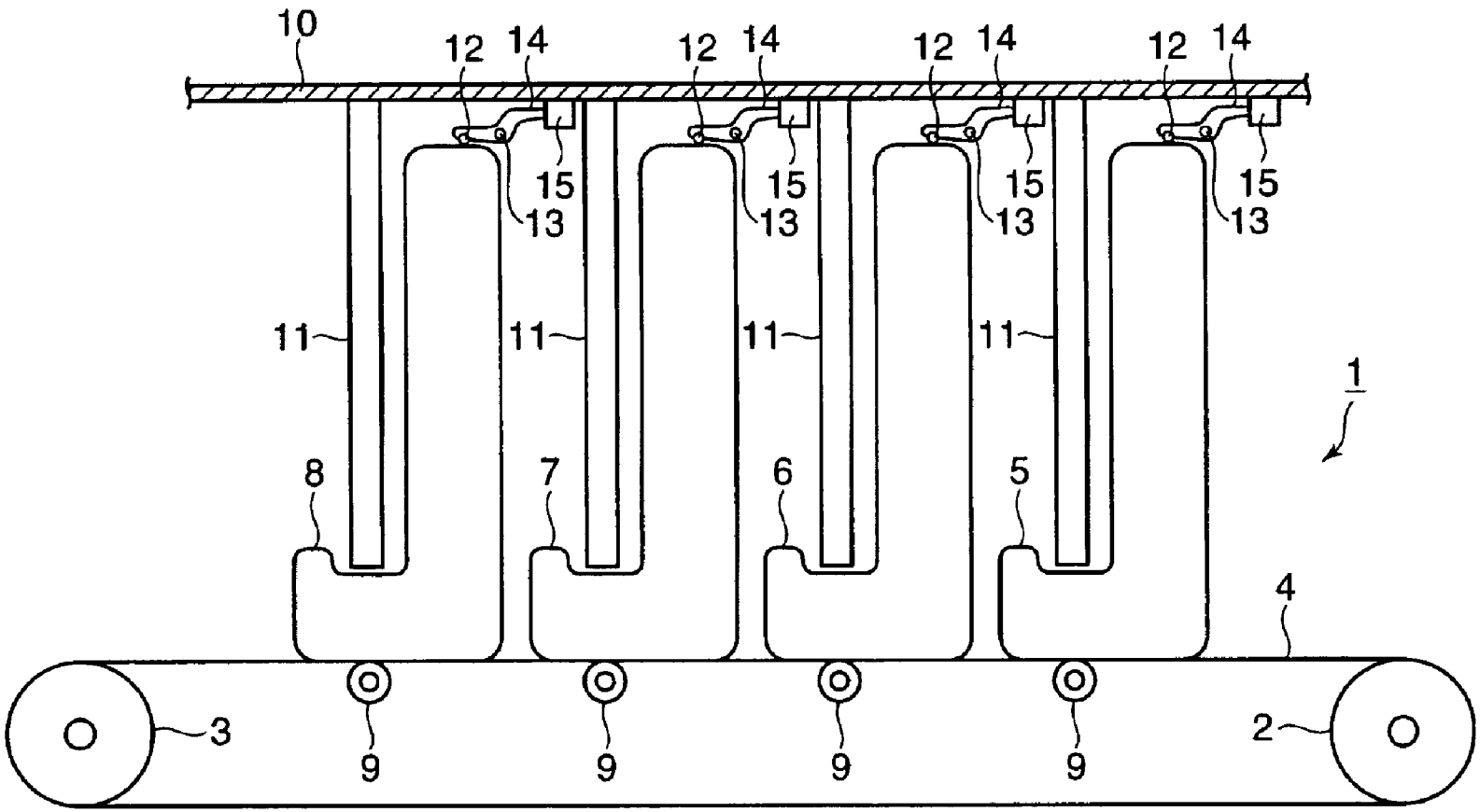
FIG. 2 is an illustrative diagram of an electrophotographic color recording apparatus according to a first embodiment.

FIG. 2 is an illustrative diagram of an electrophotographic color recording apparatus according to a first embodiment.

An electrophotographic recording apparatus 1 includes a medium-transporting belt 4, drive rollers 2 and 3, and image forming sections 5–8. The medium-transporting belt 4 extends in a direction in which the medium is transported. The transporting belt 4 is mounted about the drive rollers 2 and 3. The image forming sections 5–8 are aligned along the medium-transporting belt 4. The image forming sections 5–8 are of the same configuration and form yellow, magenta, cyan, and black images. The image forming sections 5–8 each include a print process cartridge 16 and a transfer roller 9. The transfer rollers 9 are aligned along the medium-transporting belt 4. The electrophotographic color recording apparatus has a cover 10. The cover 10 includes an exposing unit 11, a sensor lever 14, and a sensor 15. The sensor 15 takes the form of, for example, a photo sensor. The sensor lever 14 includes a permanent magnet 12 and a pivot shaft 13. The permanent magnet 12 is fixedly mounted to a first end of the sensor lever 14. The pivot shaft 13 supports the sensor lever 14 thereon such that the sensor lever 14 is rotatable. The pivot shaft 13 is press-fitted into a bracket, not shown, provided on the cover 10. The sensor 15 is switched between ON and OFF states according to the movement of the sensor lever 14.

Figure 3:
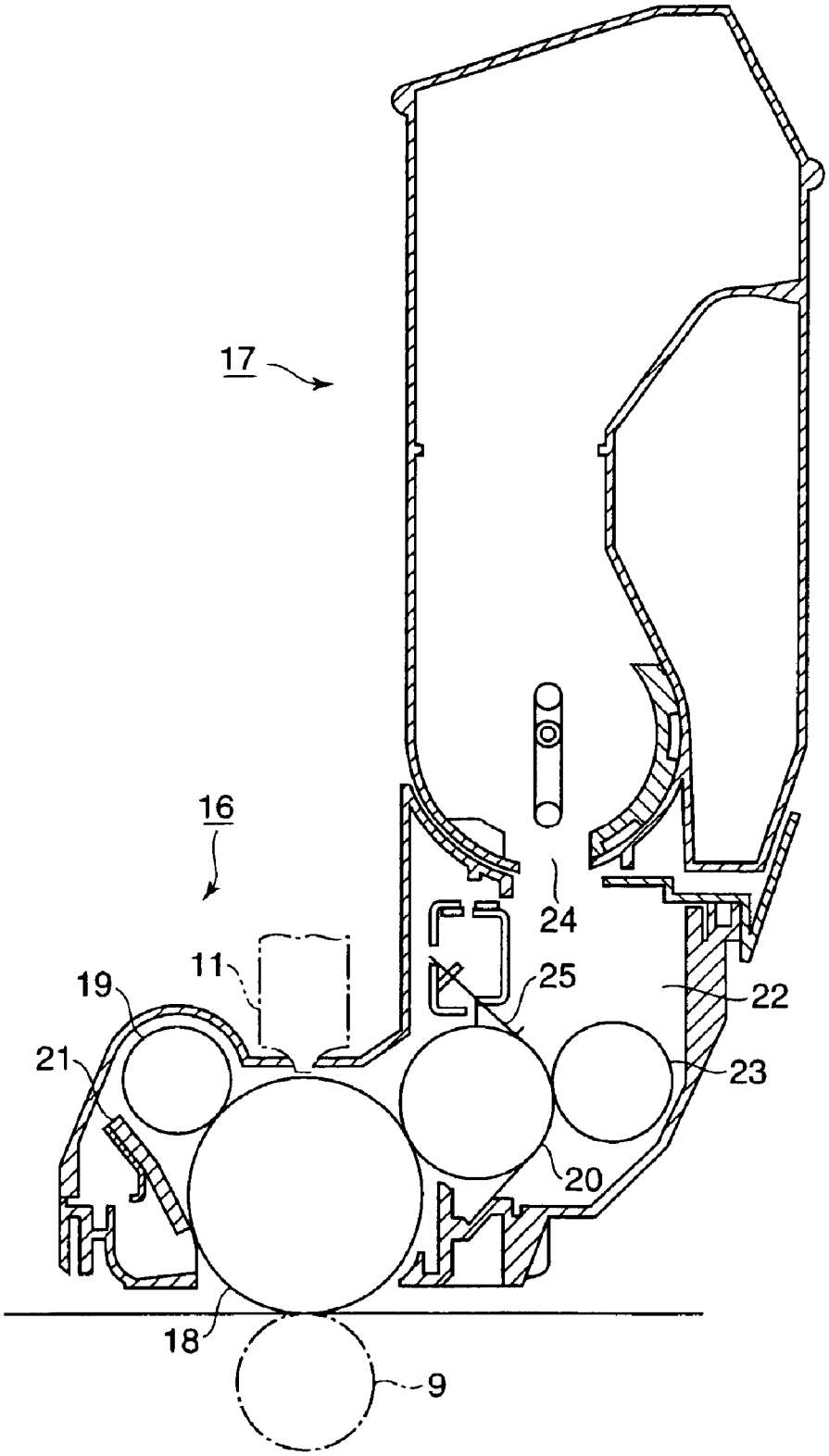
FIG. 3 is a cross-sectional view of an image forming section.

FIG. 3 is a cross-sectional view of the image forming section.

An image forming section 5 includes a print process cartridge 16, an exposing unit 11, and a transfer roller 9. The print process cartridge 16 is detachably mounted to the image forming section 5. The print process cartridge 16 includes a toner cartridge 17, a photoconductive drum 18, a charging roller 19, a developing unit 22, and the toner cartridge 17 is detachably attached to the print process cartridge 16. An image to be printed is formed on the photoconductive drum 18. The photoconductive drum 18 extends in a direction perpendicular to a direction in which the medium is transported. The photoconductive drum 18 includes a charging roller 19, an exposing unit 11, a developing roller 20, a transfer roller 9, and cleaning blade 21, which are surrounding the photoconductive drum 18. The charging roller 19 charges the surface of the photoconductive drum 18 uniformly. The exposing unit 11 illuminates the surface of the photoconductive drum 18 in accordance with print data. When the surface of the photoconductive drum 18 is exposed to the light from the exposing unit 11, an electrostatic latent image is formed on the surface of the photoconductive drum 18. The developing roller 20 applies toner on the electrostatic latent image on the photoconductive drum 18 to form a toner image. The transfer roller 9 transfers the toner image onto the print medium from the photoconductive drum 18. The print medium is transported on the medium transporting belt 4. The cleaning blade 21 scratches the residual toner that has failed to be transferred and remained on the photoconductive drum 18. The developing unit 22 has the developing roller 20 and the toner-supplying roller 23. The toner-supplying roller 23 is in pressure contact with the developing roller 20.

The toner cartridge 17 has a fresh toner chamber and an opening 24 through which the toner is discharged. The toner is supplied to the developing unit 22 through the opening 24. The toner is charged by the developing roller 20 and toner supplying roller 23. The charged toner is supplied to the developing roller. A blade 25 is in pressure contact with the developing roller 20. The blade 25 makes a thin layer of toner on the developing roller 20 as the developing roller 20 rotates.

Figure 4:
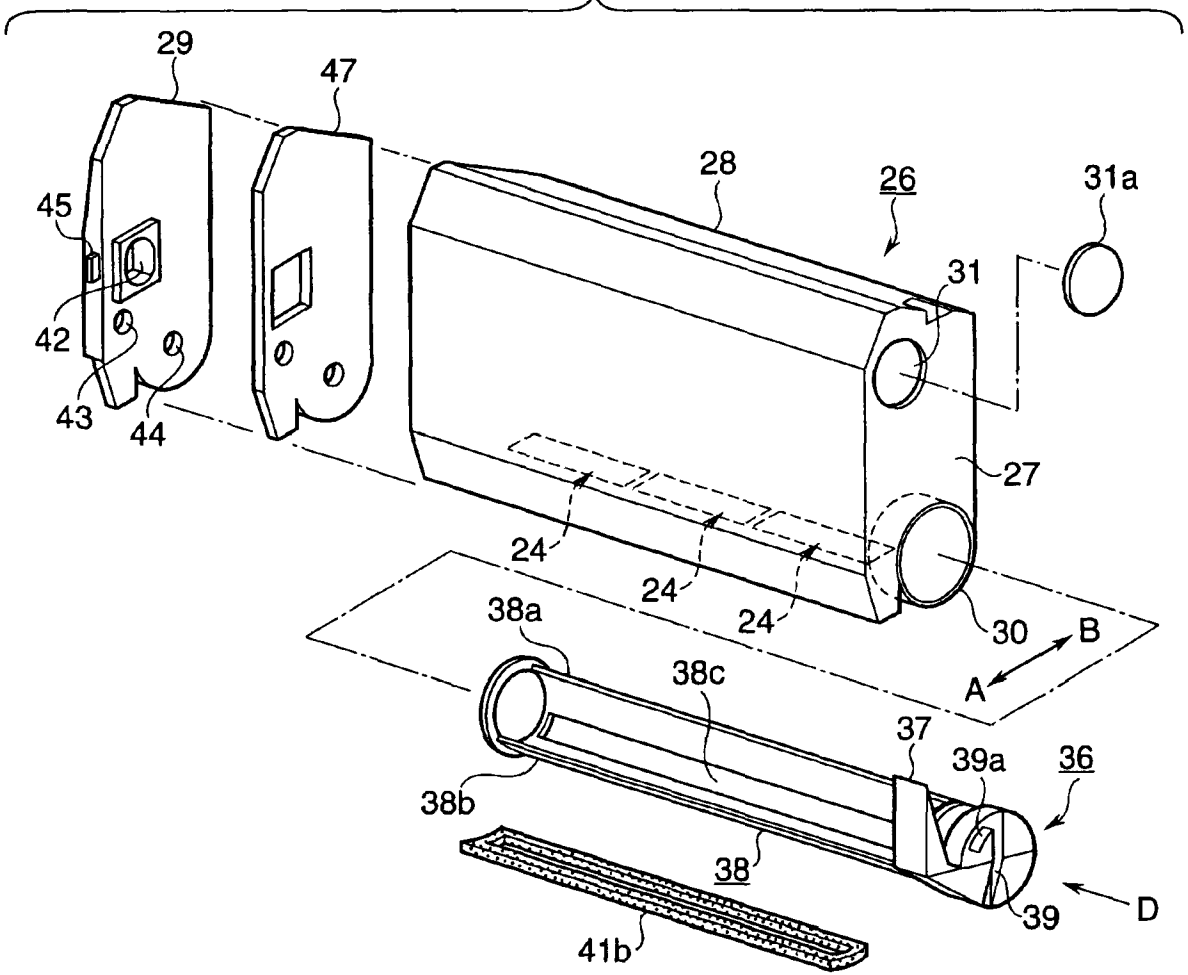
FIG. 4 is a first exploded perspective view of the toner cartridge.

FIG. 4 is a first exploded view of the toner cartridge of the embodiment.

Figure 5:
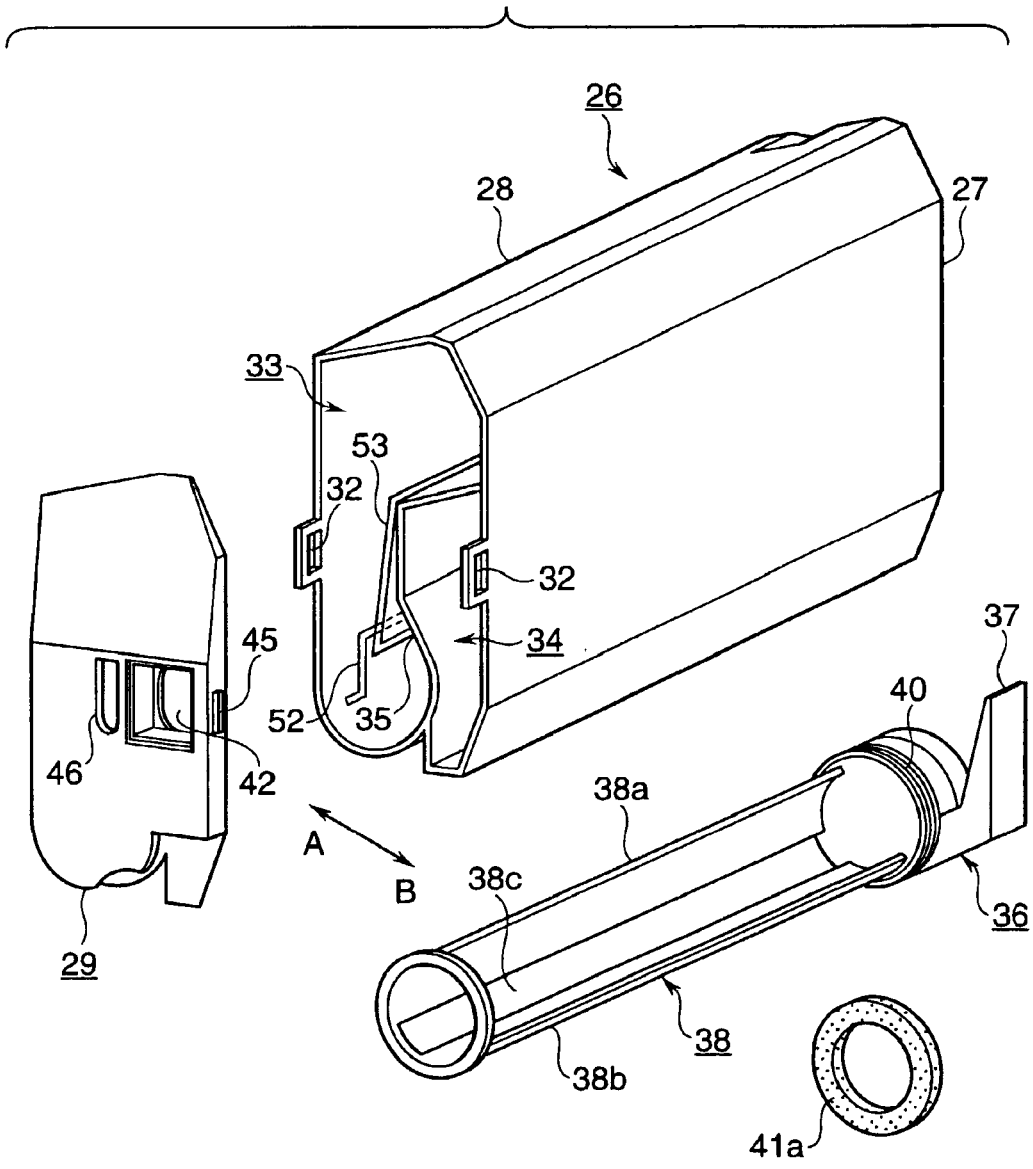
FIG. 5 is a second exploded perspective view of the toner cartridge.

FIG. 5 is a second exploded view of the toner cartridge of the embodiment.

Figure 6:
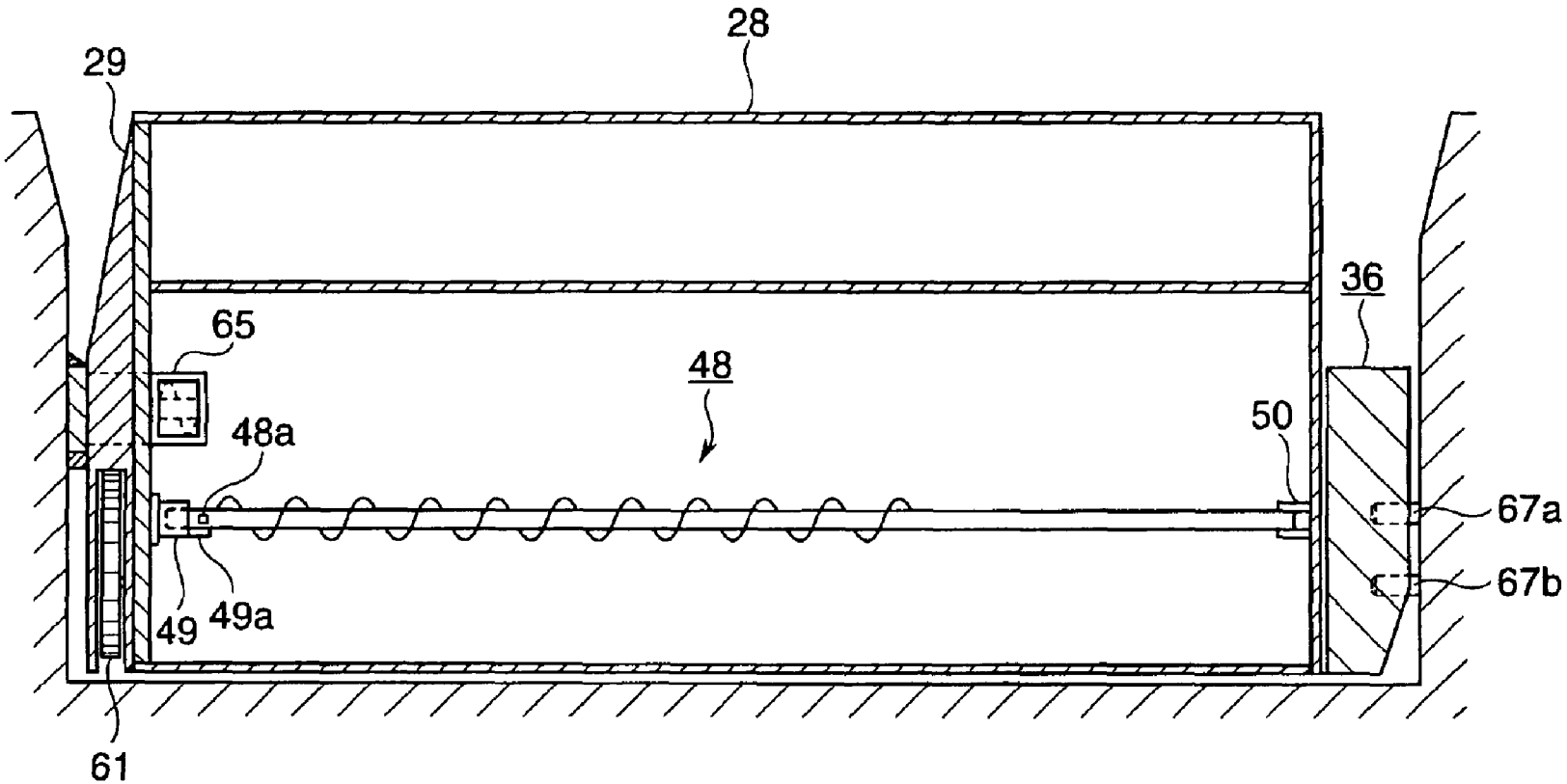
FIG. 6 illustrates a waste toner chamber in detail.

FIG. 6 illustrates the details of the waste toner chamber.

Figure 7:
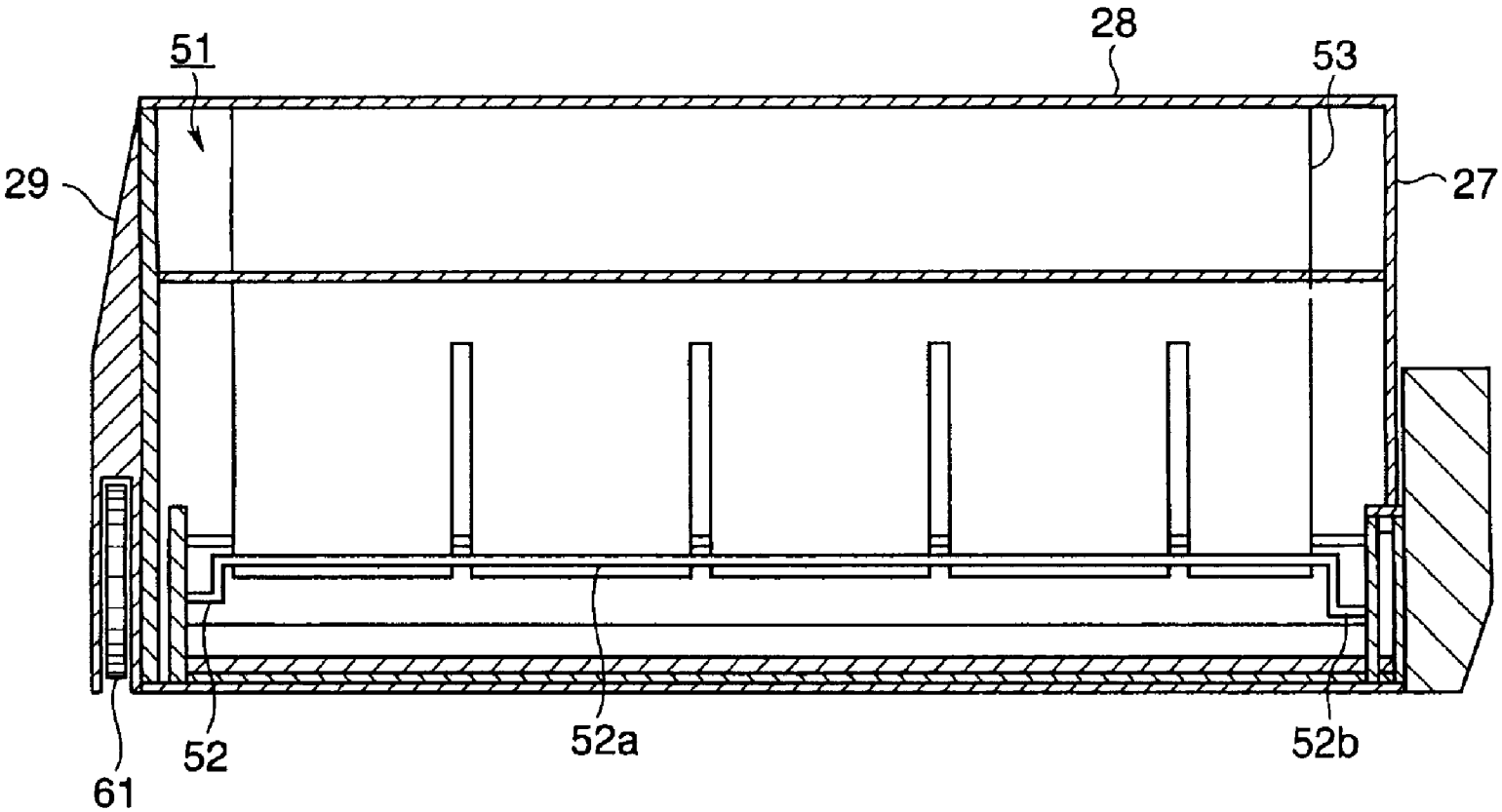
FIG. 7 illustrates a fresh toner chamber in detail.

FIG. 7 illustrates the details of the fresh toner chamber.

Figure 8:
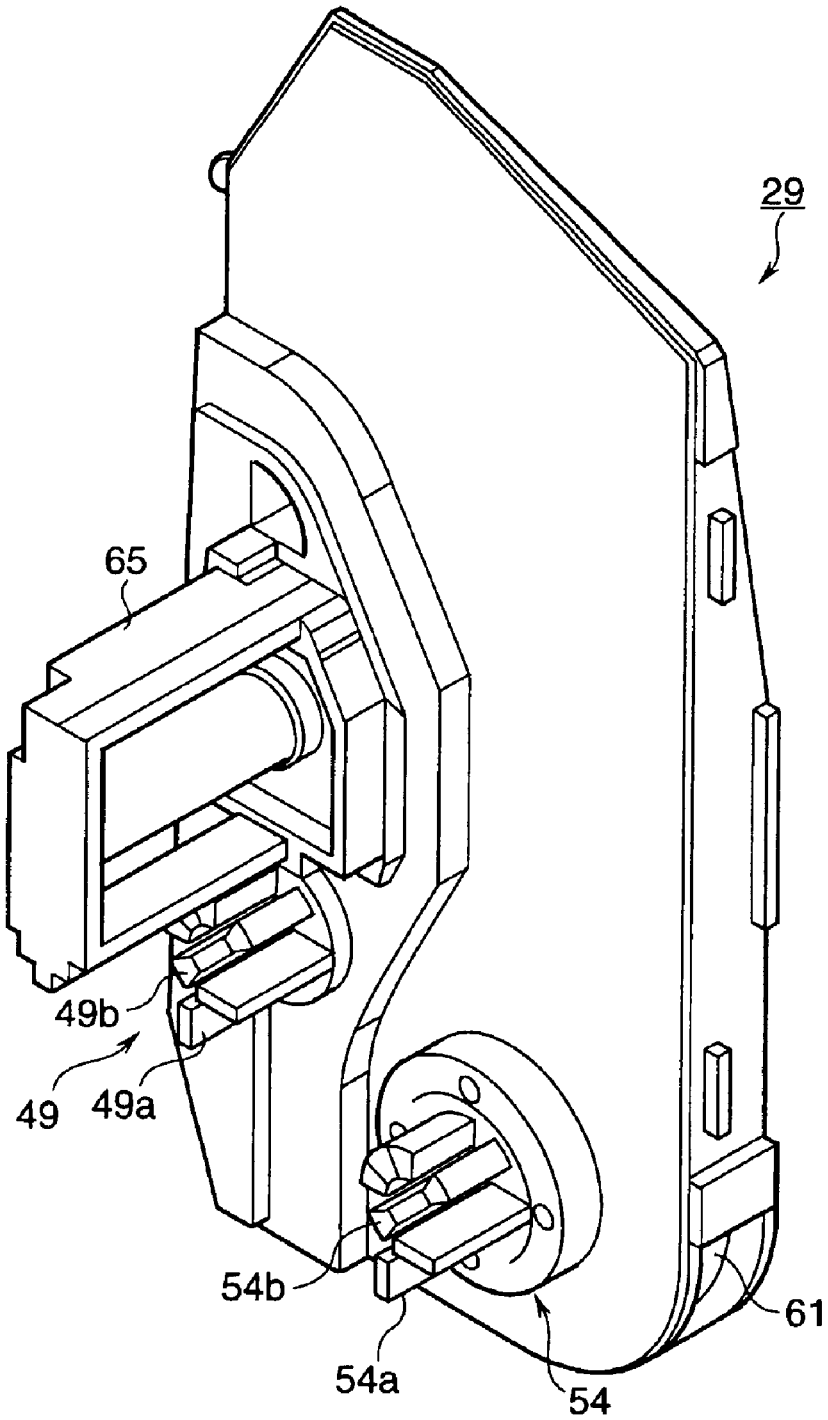
FIG. 8 illustrates a side plate in detail.

FIG. 8 illustrates the details of a side plate.

Figure 9:
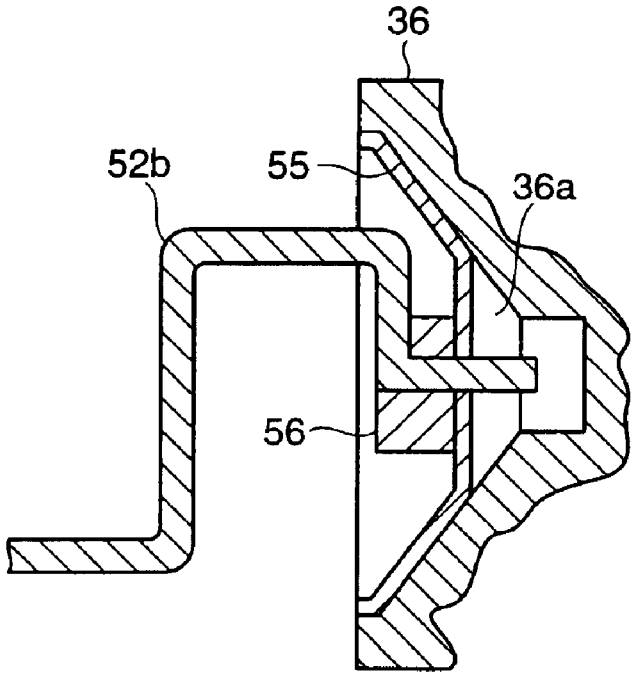
FIG. 9 illustrates the relation between an operating knob and an agitating shaft.

FIG. 9 illustrates the relationship between an operating knob and an agitating shaft.

Figure 10:
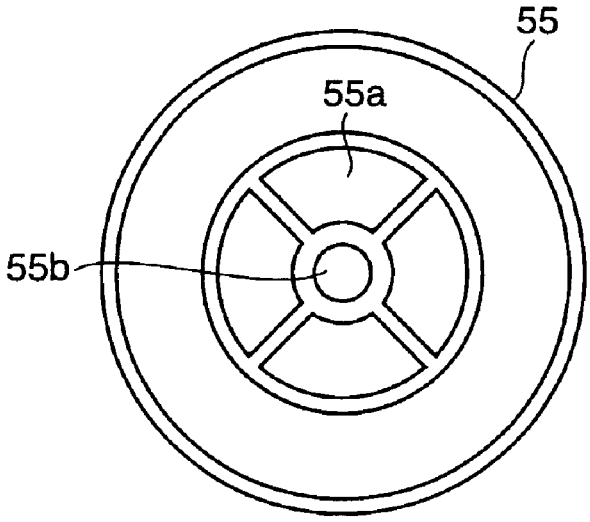
FIG. 10 illustrates a bearing member.

FIG. 10 is a front view of a bearing portion.

The cartridge case 26 of the toner cartridge 17 has a body case 28. As shown in FIG. 4, the body case 28 is in one piece construction with a side wall 27. The cartridge case 26 has a side plate 29. The side plate 29 is fitted into the body case 28, thereby forming another side wall. A cylindrical boss 30 is formed in the side wall 27. The boss 30 couples a later described operating knob. The side wall 27 is formed with a toner-filling opening 31. A cap 31*a* is fitted into the toner-filling opening 31. The cap 31*a* is desirably made of a colorless transparent material or colorless translucent material, so that the toner can be seen through the cap 31*a*. The body case 28 has fitting holes 32 formed in the circumferential portion of the body case 28. The side plate 29 has projections 45 that fit into the fitting holes 32. When the side plate 29 and body case 28 are fitted together, the projections 45 fit into the fitting holes 32. The cartridge case 26 has the fresh toner chamber 33 and the waste toner chamber therein. The fresh toner chamber 33 holds fresh, unused toner therein. The waste toner chamber 34 holds waste toner that has failed to be transferred. The waste toner that has failed to be transferred is delivered from a cleaning unit, not shown, to the toner cartridge. The fresh toner chamber 33 and waste toner chamber 34 are integrally constructed and partitioned by an inner wall 35 of the body case 28.

The waste toner chamber 34 is located beside the fresh toner chamber 33 in the direction of width (direction shown by arrows A and B). The fresh toner chamber 33 has a bottom wall in which a plurality of openings 24 are formed. As shown in FIG. 4, the plurality of openings 24 are aligned in the direction of length of the cartridge case 26. The boss 30 of the side wall 27 receives an operating knob 36. The operating knob 36 includes a knob 37 and a shutter 38 formed in one-piece construction. The shutter 38 is configured to the inner wall of the fresh toner chamber, thereby closing the opening 24. The knob 36 has a guide groove 39 formed in its outer surface. The guide groove 39 receives projections 67*a* and 67*b* of the print process cartridge 16, which will be described later. The knob 36 has a groove 40 formed therein as shown in FIG. 5. The groove 40 receives a seal sponge 41*a* in the shape of a doughnut. The seal sponge 41*a* prevents the fresh, unused toner in the fresh toner chamber 33 from leaking from the operating knob 36 side. A seal sponge 41*b* is mounted by, for example, an adhesive to the outer peripheral portion of the shutter 38. The seal sponge 41*b* closes the opening 24 when the shutter 38 is at a predetermined position. The seal sponge 41*b* prevents the unused toner in the fresh toner chamber 33 from leaking through the opening 24. The side plate 29 is generally configured to the cross section of the body case 28. The side plate 29 has an opening 42 formed therein. The waste toner recovered from outside the toner cartridge is introduced into the waste toner chamber 34 through the opening 42. The side plate 29 has two holes 43 and 44 that receive later described bosses 49 and 54. The holes 43 and 44 correspond to the fresh toner chamber 33 and the waste toner chamber 34. The side plate 29 has projections 45 formed on end surfaces of the side plate 29. When the side plate 29 is assembled to the body case 28, the projections 45 fit into the fitting holes 32 formed in the body case 28. The side plate 29 also has a recess 46 formed in its side surface. The recess 46 receives a projection that will be described later, thereby preventing the toner cartridge 17 from rotating or disengaging from the print process cartridge. The seal sponge 47 having substantially the same shape as the side plate 29 is provided in intimate contact with the side plate 29.

The waste toner chamber 34 includes a spiral shaft 48 that serves as a toner-advancing member. The spiral shaft 48 has a length that spans substantially across the length of cartridge case 17. The spiral shaft 48 is received at its one end by a recess 49*b* formed in a boss 49. The boss 49 is rotatably received in a bearing hole 43 in the side plate 29 shown in FIG. 8. The spiral shaft 48 has a projection 48 that abuts a projection 49*a* formed on the boss 49. The spiral shaft 48 is supported at its another end by a bearing 50. The bearing 50 is formed on the side wall 27 in one piece with the body case 28. The fresh toner chamber 33 incorporates a toner agitating mechanism 51 and an opening 24, and holds toner. The toner agitating mechanism 51 agitates the toner. The toner falls by its weight through the opening 24. The toner is supplied through the opening 24 into the developing unit. The toner agitating mechanism 51 has a length that spans substantially across the length of the cartridge 17 as shown in FIG. 7. The toner agitating mechanism 51 has an agitating shaft 52 that includes a first crank 52*a*, and a second crank 52*b*. The first crank 52*a* agitates the toner. The second crank 52*b* opposes the first crank 52*a*. The toner agitating mechanism 51 has a toner-agitating shaft 52. The toner-agitating shaft 52 extends across the walls 27 and 29 and is rotatable. The agitating shaft 52 is near the opening 24. A flap 53 is securely fixed at its upper end to an upper wall of the body case 28. The flap 53 has a lower end that abuts the first crank 52*a* when the first crank 52*a* reaches near its top dead center. The agitating shaft 52 has one end received in a bearing 54*b* in a boss 54. The boss 54 is received in the hole 44. The first crank 52*a* of the agitating shaft 52 abuts at its one longitudinal end the projection 54*a*. The projection 54*a* is on the boss 54. The operating knob 36 is fitted into the boss 30. The boss 30 is on the side wall 27 in one piece with the body case 28. As shown in FIG. 9, the operating knob 36 has a recess in the shape of a truncated circular cone and concentric to the knob 36.

A bearing or retainer 55 is in the shape of a truncated circular cone and is fixed to the operating knob 36. The bearing 55 is made of a film material. The other end of the agitating shaft 52 fits into a groove formed in a piece 56. The piece 56 has a certain thickness so that the second crank 52*b* does not interfere with the bearing 55. The other end of the agitating shaft 52 is rotatably supported in the middle portion of the bearing 55. The bosses 49 and 54 are coupled to a gear train 61 through resilient ratchets.

As shown in FIG. 8, the gear train 61 drives the bosses 49 and 54 in rotation. The gear train 61 is coupled to a drive force transmitting gear 68 on the print process cartridge 16. When the drive force transmitting gear 68 rotates, the gear train 61 rotates. When the drive source 69 rotates, the drive force transmitting gear 68 is driven in rotation by the drive source 69. A drive source 69 is on the electrophotographic color recording apparatus side. The print process cartridge 16 can be moved into and out of engagement with the drive source 69.

Figure 11:
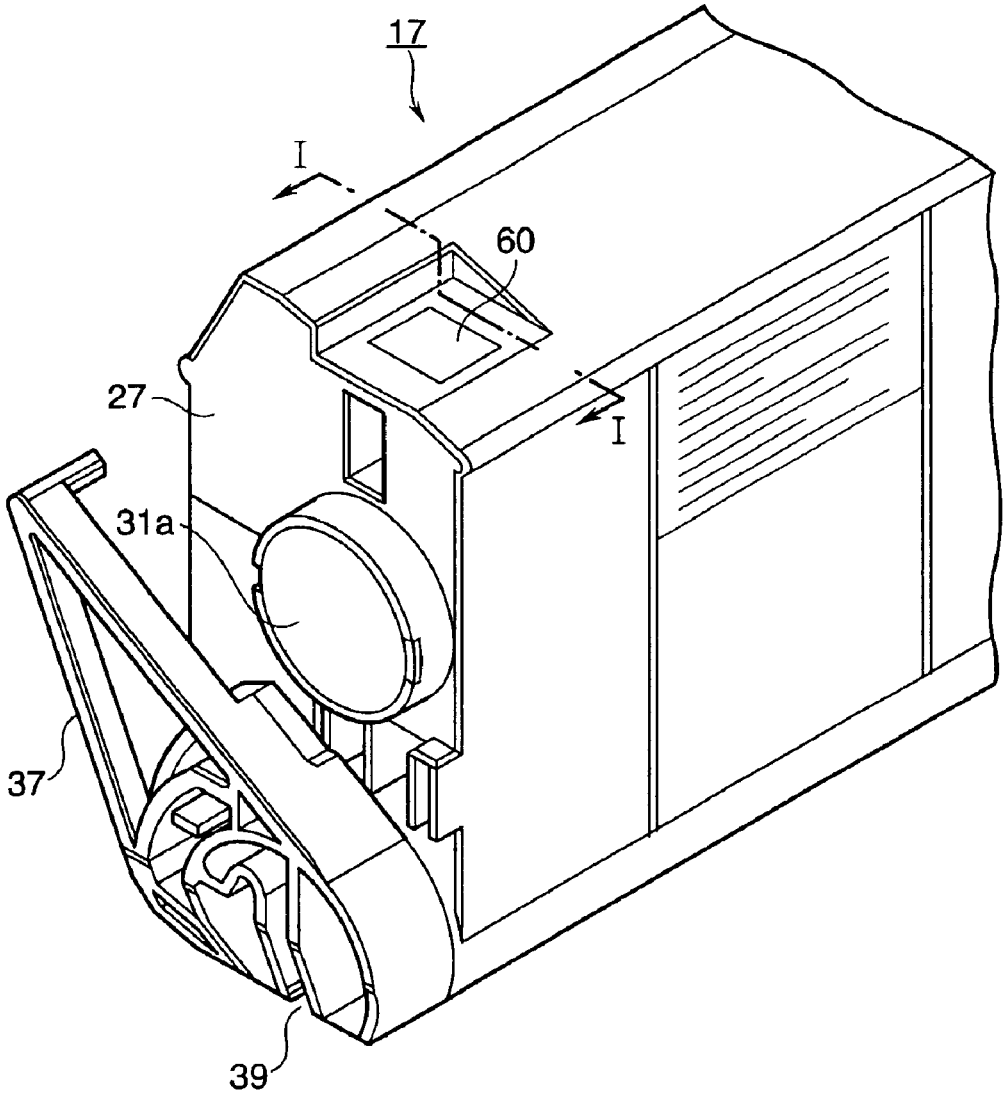
FIG. 11 is a fragmentary perspective view of the toner cartridge.

FIG. 11 is a fragmentary perspective view of a toner cartridge 17.

FIG. 1 is a cross sectional view of the toner cartridge 17 taken along line I—I of FIG. 11.

The second crank 52*b* has one end pivotally coupled to a first end of the fine shaft 57. A second end of the fine shaft 57 fits slidably into a guide 58. The guide 58 is provided in the top wall of the body case 28 and has a top wall in the form of a film 60*a*. There is provided a magnetic body 59 on the second end of the fine shaft 57. The agitating shaft 52 rotates in a direction shown by an arrow shown in FIG. 1. As the agitating shaft 52 rotates, the second crank 52*b* approaches its top dead center and then passes the top dead center. The permanent magnet 12 is attracted to the magnetic body 59 every time the second crank 52*b* approaches its top dead center and then passes the top dead center. The permanent magnet 12 is attracted to the magnetic body 59 through the film 60*a*. The permanent magnet 12 is fixed to one end of the sensor lever 14. The sensor lever 14 performs a rocking motion about a supporting shaft 13 due to attraction force of the permanent magnet 12. The sensor lever 14 causes the sensor 15 to be ON and OFF. The film 60*a* has a thickness of 0.2 mm and is colorless and transparent or colorless and translucent. The film 60*a* allows visual check of the color of toner held in the cartridge. The toner cartridge 17 receives inadvertent shock and vibration before it is completely attached to the print process cartridge 16. The agitating shaft 52 of the toner cartridge 17 may rotate due to vibration. The toner cartridge 17 has the following configuration in order to prevent inadvertent rotation of the agitating shaft 52.

The shutter 38 has an anti-rotation film 60*b* provided on the inner side thereof. The boss 54 has a projection 54*a*. The first crank 52*a* is sandwiched between a projection 54*a* and the anti-rotation film 60*b*.

Figure 12:
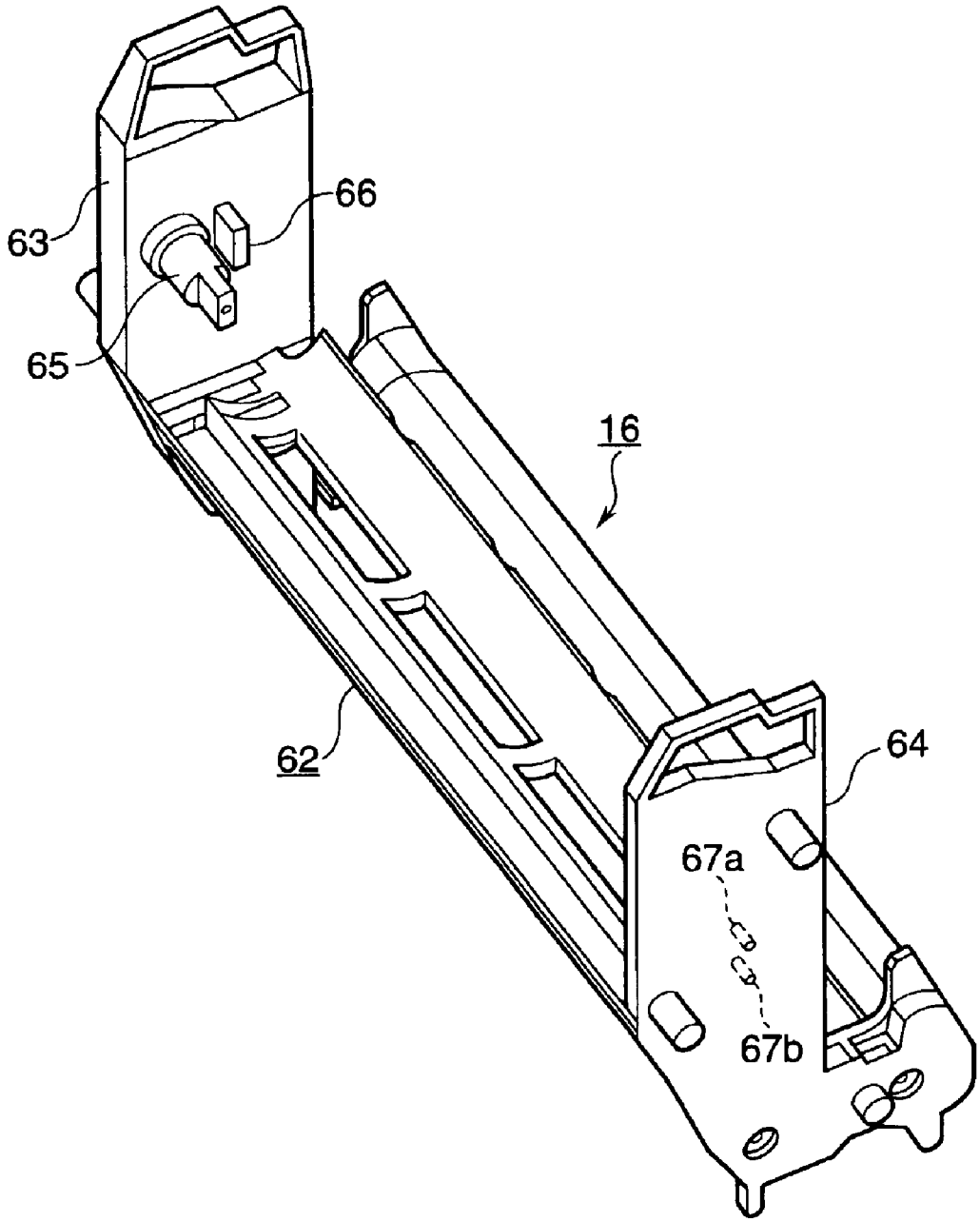
FIG. 12 is a fragmentary perspective view of a print process cartridge.

FIG. 12 is a perspective view of the print process cartridge. The print process cartridge 16 has side walls 63 and 64 formed in one piece. The side walls 63 and 64 extend upwardly from longitudinal ends of the side body case 62. As shown in FIG. 3, the body case 62 includes a photoconductive drum 18, a charging roller 19, a developing roller 20, a cleaning blade 21, and a toner supplying roller 23. The side wall 63 includes a waste toner exit 65 and a projection 66. The waste toner exit 65 serves as a discharging opening through which the waste toner is discharged into the toner cartridge 17. When toner cartridge 17 is attached to the print process cartridge 16, the waste toner exit 65 fits to the opening 42. When the toner cartridge 17 is attached to the print process cartridge 16, the projection 66 fits into the recess 46. The side wall 64 has projections 67*a* and 67*b* formed thereon. When the toner cartridge 17 is attached to the print process cartridge 16, the projections 67*a* and 67*b* enter and fit into a guide groove 39 formed in the operating knob 36 as shown in FIG. 4.

Figure 13:
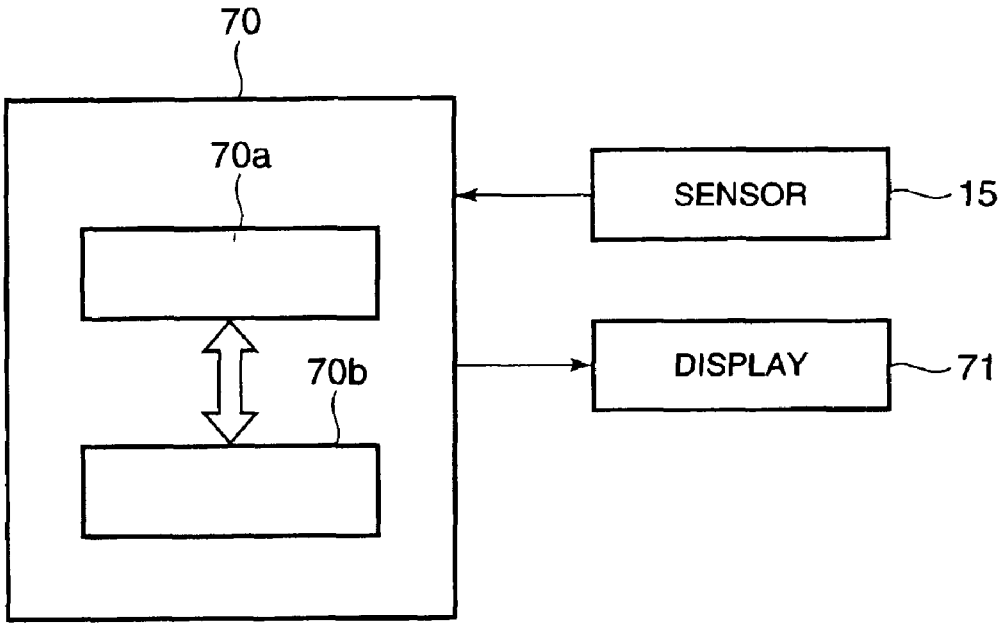
FIG. 13 is a control block diagram for detecting an amount of remaining toner in the toner cartridge.

FIG. 13 is a control block diagram illustrating the operation of detecting an amount of the remaining toner in the toner cartridge. The controller 70 includes a sensor 15, a display 71, a central processing unit 70*a* (referred to as CPU 70*a*) and a memory 70*b*. The memory 70*b* stores a threshold value below which it is determined that the toner cartridge 17 should be replaced. The memory 70*b* stores a message of replacement of the toner cartridge 17 that is displayed on a display 71.

The operation of attaching the toner cartridge into the print process cartridge will now be described.

Figure 14:
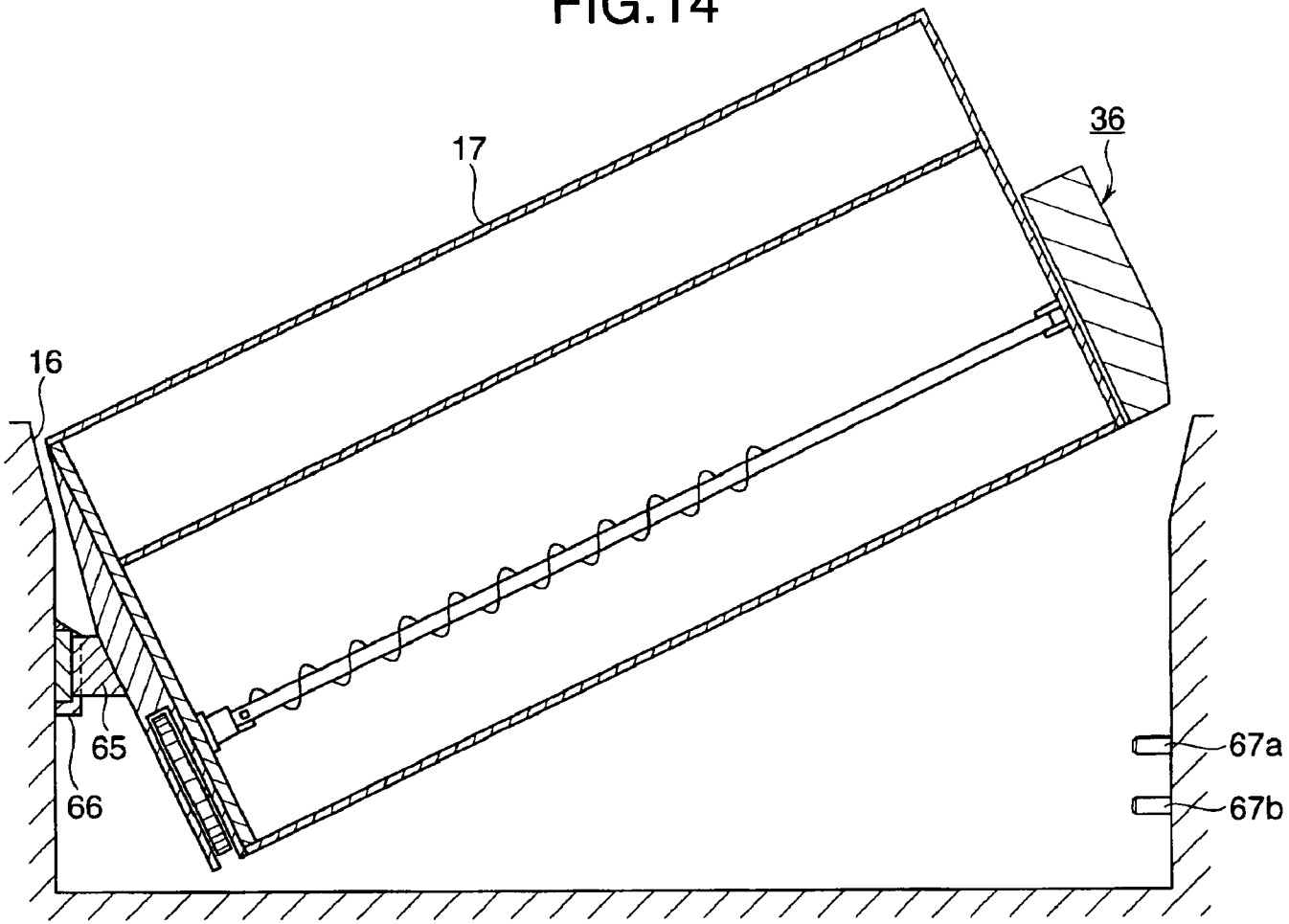
FIG. 14 is a first diagram, illustrating how the toner cartridge is attached to the print process cartridge.

FIG. 14 illustrates the operation of attaching the toner cartridge.

Figure 15:
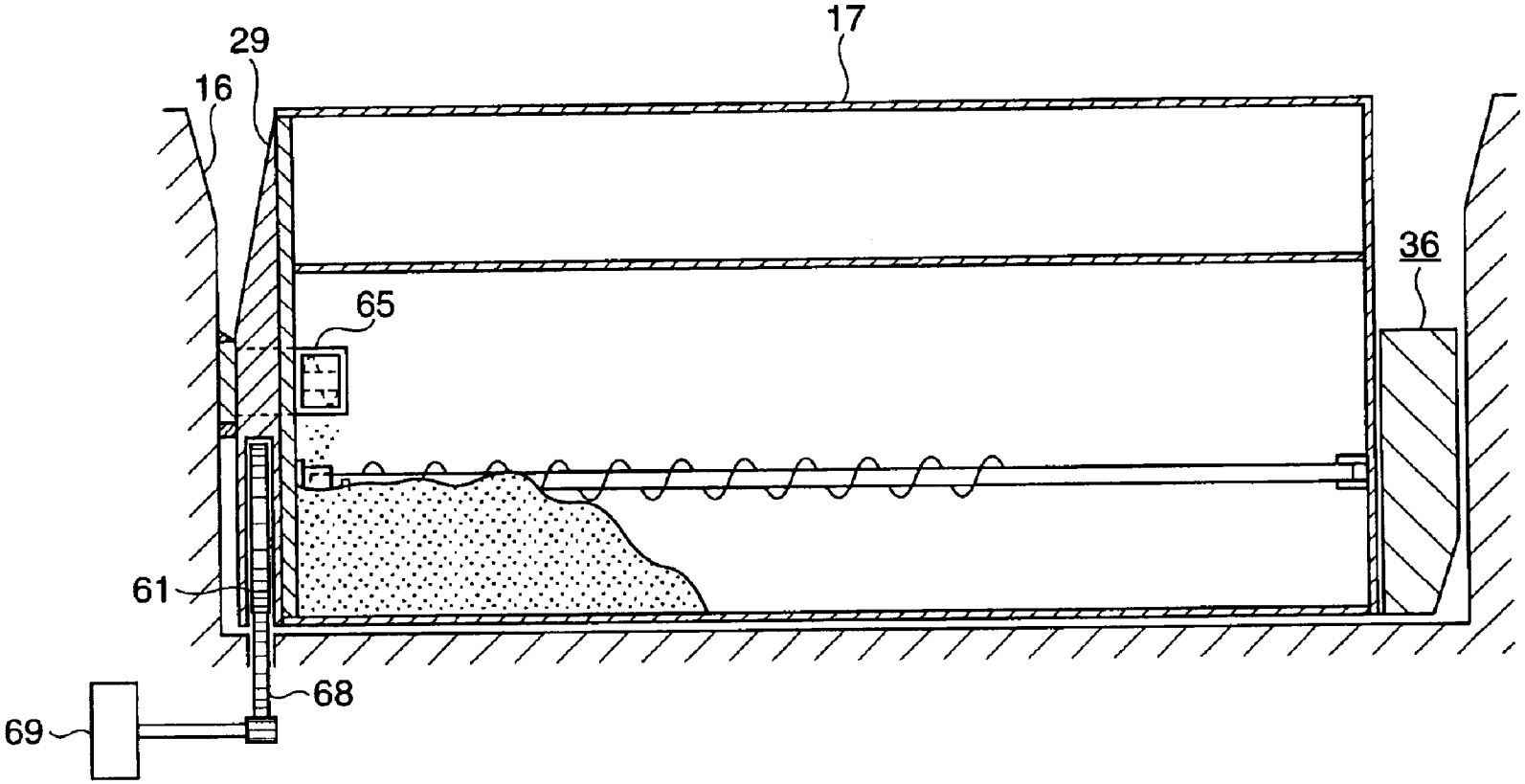
FIG. 15 is a second diagram, illustrating how the toner cartridge is attached to the print process cartridge.

FIG. 15 illustrates the operation of attaching the toner cartridge.

Figure 16A:
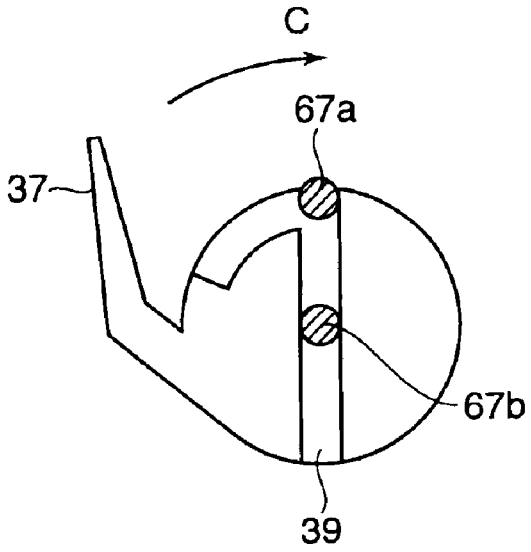
FIG. 16A is an illustrative diagram (A), illustrating a toner supplying operation according to the present invention.

FIG. 16A illustrates the knob 37 before it is rotated.

Figure 16B:
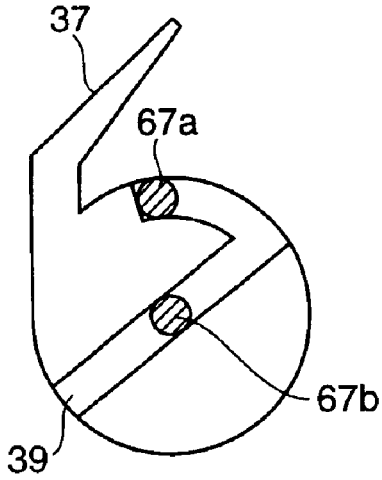
FIG. 16B is an illustrative diagram (B), illustrating a toner supplying operation according to the present invention.

FIG. 16B illustrates the knob 37 after it is rotated.

The toner cartridge 17 is first inserted into the print process cartridge as shown in FIG. 14. The toner exit 65 fits into the opening 42 formed in a side frame 29. At this moment, the first crank 52*a* of the agitating shaft 52 is at its bottom dead center and the first crank 52*a* is sandwiched between the projection 54*a* of the boss 54 and the anti-rotation film 60*b*. Because the agitating shaft 52 is sandwiched, the agitating shaft 52 will not rotate even if the toner cartridge is subjected to vibration. When the first crank 52*a* is at its bottom dead center, the second crank 52*b* is at its top dead center. When the second crank 52*b* is at its top dead center, the fine shaft 57 is close to the upper wall. The gap between the film 60*a* and the magnetic body 59 mounted on the fine shaft 57 is small. The film 60*a* is mounted to the upper wall of the guide 58. First, the toner cartridge 17 is held horizontal and the operating knob 36 side is lowered. At this stage, the projection 66 fits to the recess 46 shown in FIG. 5. The recess 46 is formed in the side frame 29. The projection 66 in on the print process cartridge. As the operating knob 36 is lowered, the projections 67*a* and 67*b* enter the guide groove 39 as shown in FIG. 15. The projections 67*a* and 67*b* are on the print process cartridge 16. The guide groove 39 is formed in the knob 37. When the toner cartridge 17 becomes horizontal, the knob 37 is rotated in a direction shown by arrow C as shown FIG. 16A. When the knob 37 is rotated in a direction shown by arrow C, the projections 67*a* and 67*b* fit into the guide groove 39 of the toner cartridge. When the projections 67*a* and 67*b* fit into the guide groove 39 of the toner cartridge, the toner cartridge 17 is fixed to the print process cartridge 16. The shutter 38 has the knob 37 in one piece. When the shutter 38 is rotated in the direction shown by arrow C, the toner is supplied through the opening 24. The fresh, unused toner is supplied through the opening 24 from the fresh toner chamber to the print process cartridge 16.

The operation of detecting an amount of the remaining toner in the toner cartridge will now be described.

Figure 17A:
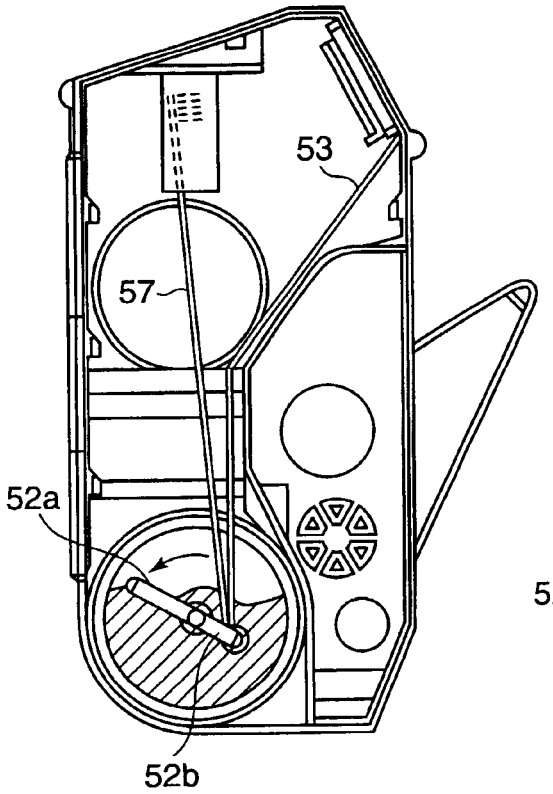
FIG. 17A illustrates the present invention when an amount of the remaining toner is sufficient.
Figure 17B:
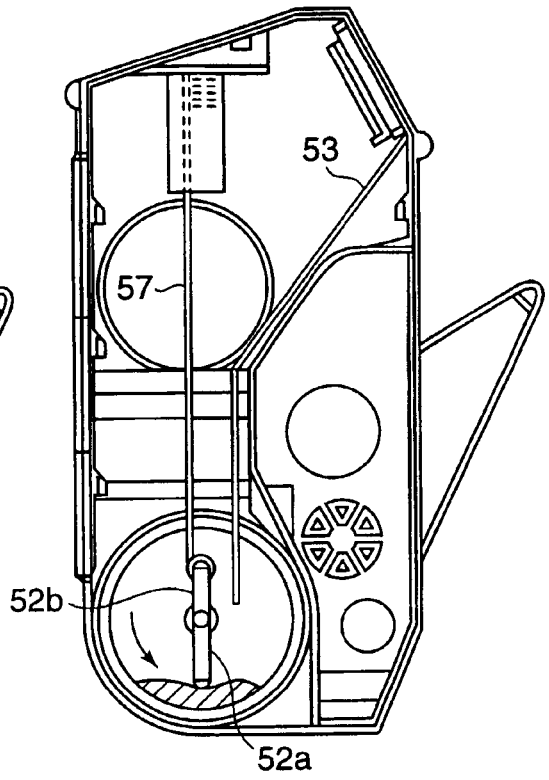
FIG. 17B illustrates the present invention when an amount of the remaining toner is not sufficient.
Figure 17C:
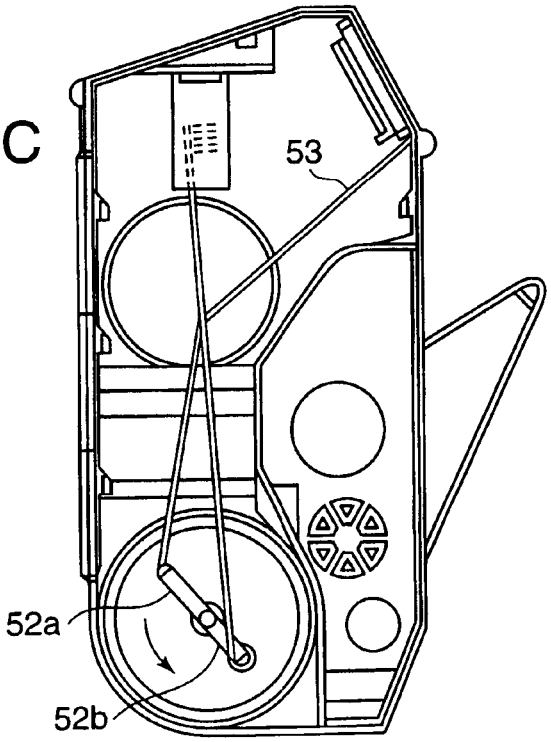
FIG. 17C illustrates the present invention when the toner cartridge is empty of toner.

FIGS. 17A–17C illustrate the remaining toner in the toner cartridge.

FIG. 17A illustrates when the remaining toner is sufficient.

FIG. 17B illustrates when the remaining toner is not sufficient.

FIG. 17C illustrates when the toner cartridge is empty of toner.

FIGS. 18A–18E are illustrative diagrams that illustrate the operation of detecting remaining toner.

Figure 18A:
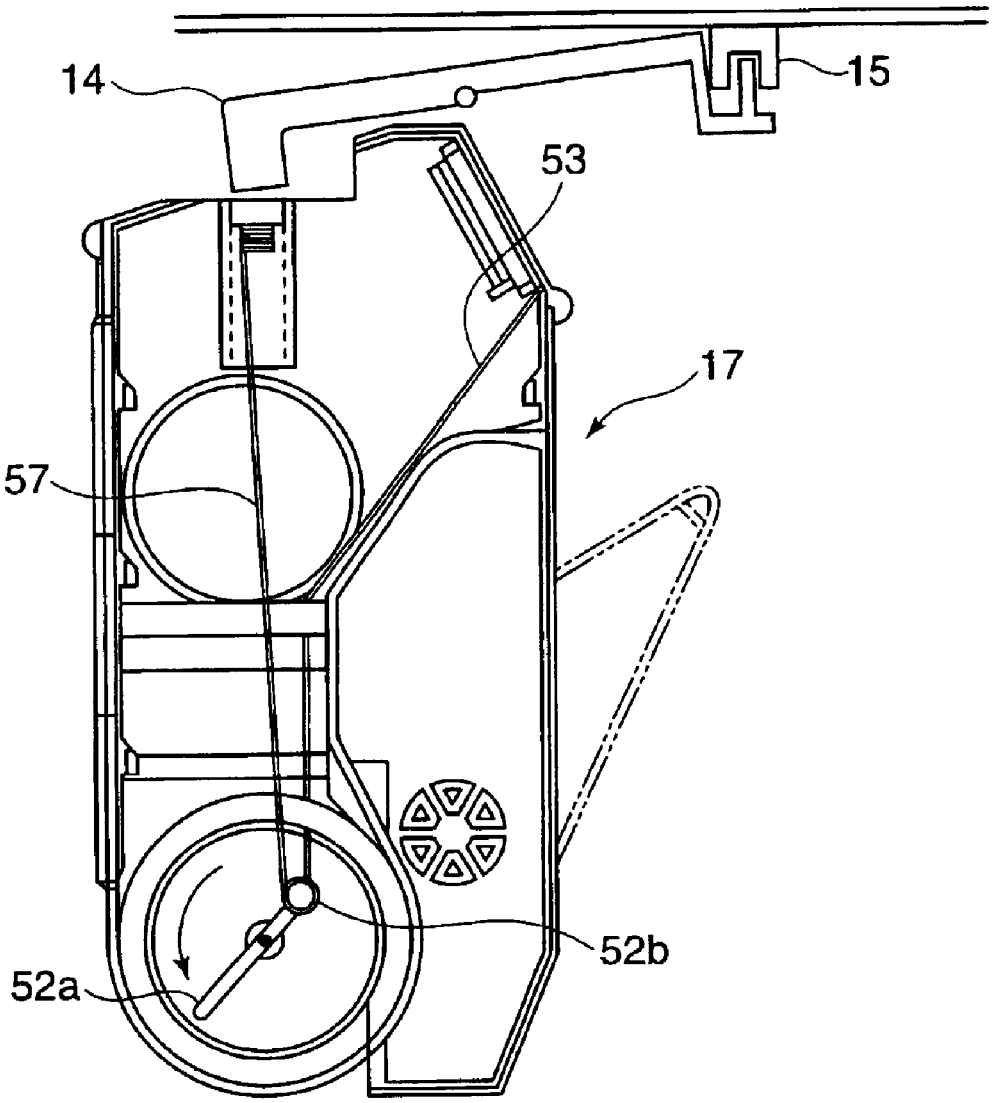
FIG. 18A is an illustrative diagram (A), illustrating the operation of the agitating shaft and the sensor.

FIG. 18A is an illustrative diagram (A), illustrating the operation of the agitating shaft and the sensor.

Figure 18B:
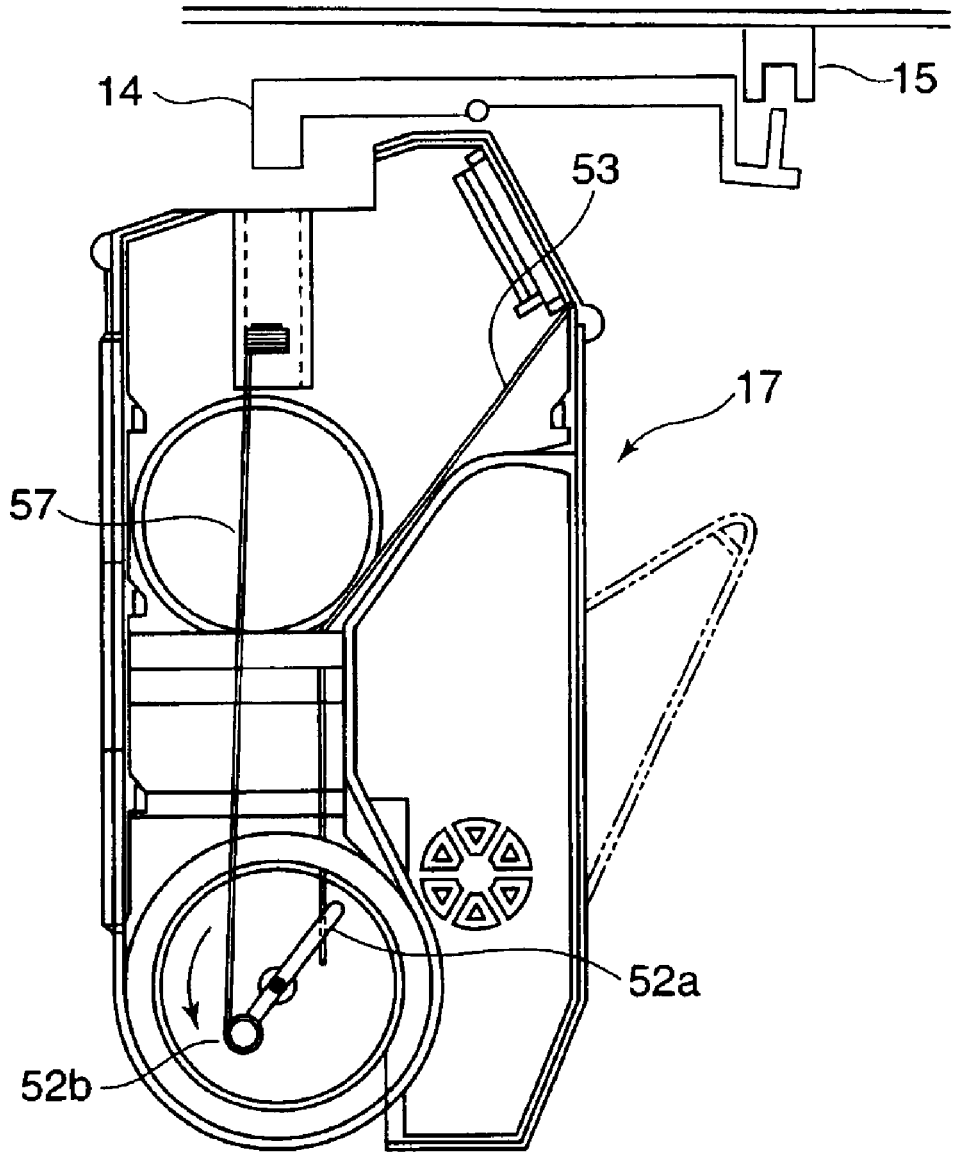
FIG. 18B is an illustrative diagram (B), illustrating the operation of the agitating shaft and the sensor.

FIG. 18B is an illustrative diagram (B), illustrating the operation of the agitating shaft and the sensor.

Figure 18C:
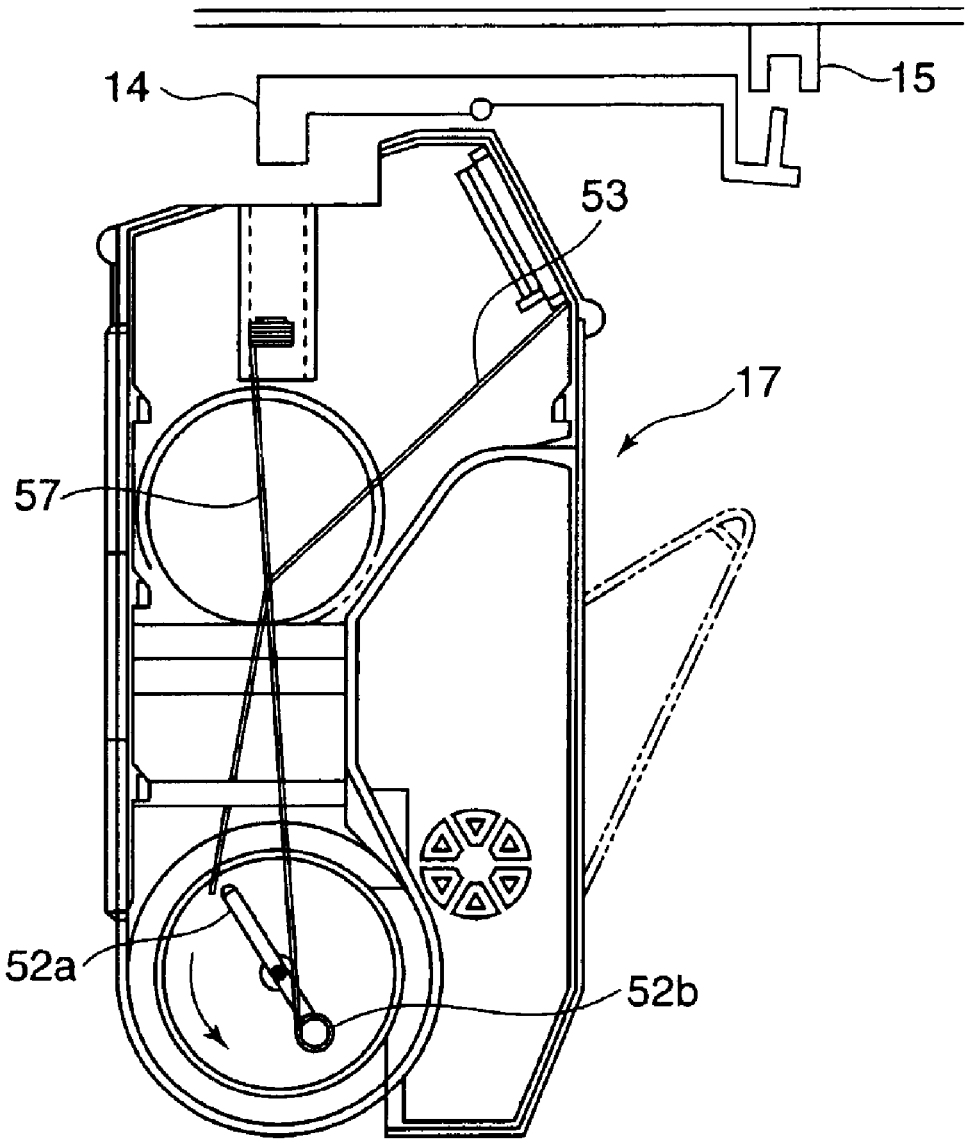
FIG. 18C is an illustrative diagram (C), illustrating the operation of the agitating shaft and the sensor.

FIG. 18C is an illustrative diagram (C), illustrating the operation of the agitating shaft and the sensor.

Figures 18D, 18E:
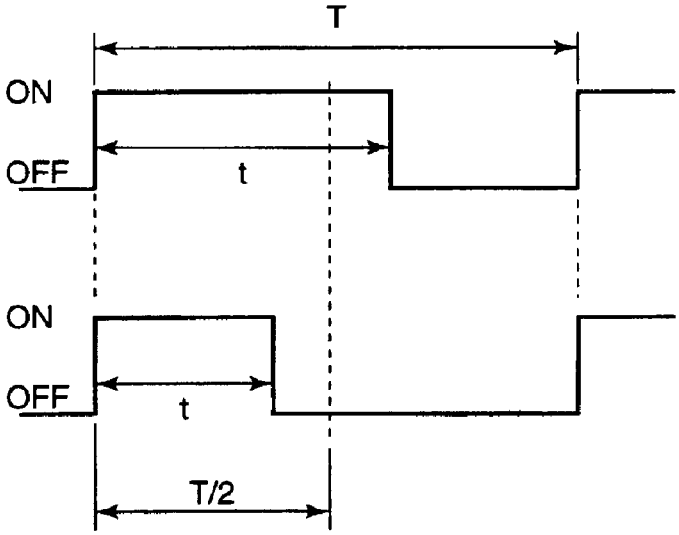
FIG. 18D is an illustrative diagram (B), illustrating the ON/OFF conditions at a toner LOW condition in which an amount of remaining toner is not sufficient.
FIG. 18E illustrates the ON/OFF conditions at a toner FULL condition in which remaining toner is sufficient.

FIG. 18D illustrates the ON/OFF conditions at a toner LOW condition in which remaining toner is not sufficient.

FIG. 18E illustrates the ON/OFF conditions at a toner FULL condition in which remaining toner is sufficient.

The image forming section 5 causes the spiral shaft 48 and agitating shaft 52 to rotate while printing is being performed. The image forming section 5 causes the cleaning blade 21 shown in FIG. 3 to scratch the residual toner that has failed to be transferred onto the print medium during printing. As shown in FIG. 15, the image forming section 5 causes the scratched residual toner to fall into the waste toner chamber 34 through the waste toner exit 65 of the print process cartridge 16. When the waste toner piles up as high as the spiral shaft 48, the spiral shaft 48 makes the top of the pile of the waste toner horizontal. The spiral shaft 48 moves the waste toner further into the waste toner chamber 34 away from the opening 42. Continuing the above operation, the spiral shaft 48 causes the waste toner to pile up in the waste toner chamber 34. The agitating shaft 52 in the fresh toner chamber 33 rotates to prevent the toner from clumping. Meanwhile, the CPU 70*a* in the controller 70 detects an amount of the remaining toner in the toner cartridge 17 by means of the sensor 15. When the remaining toner in the toner cartridge 17 is sufficient as shown in FIG. 17A, the CPU 70*a* operates as follows: That is, the second crank 52*b* of the agitating shaft 52 reaches a position shown in FIG. 18A. When the second crank 52*b* reaches the point shown in FIG. 18A, the magnetic body 59 attracts the permanent magnet 12. The magnetic body 59 is provided on the other end of the fine shaft 57. The permanent magnet 12 is fixed to one end of the sensor lever 14. When the permanent magnet 12 is attracted to the magnetic body 59, the sensor lever 14 causes the sensor to become ON as shown in FIG. 18E. At this moment, the projection 54*a* shown in FIG. 8 abuts the first crank 52*a* and rotates as the boss 54 rotates. When the boss 54 causes the first crank 52*a* to rotate, the first crank 52*a* pushes the anti-rotation film 60*b* to flex so that the first crank overrides the anti-rotation film 60 and continues to rotate.

The projection 54*a* is formed on the boss 54 that rotates together with the gear train 61. The second crank 52*b* reaches a position shown in FIG. 18B. One end of the sensor lever 14 leaves the second end of the fine shaft 57, making the sensor 15 OFF as shown in FIG. 18E. The CPU 70*a* causes a built-in timer to count the time t during which the sensor 15 is ON. The CPU 70*a* monitors the timer to determine whether the time t exceeds a threshold value. The threshold value is stored previously in a memory 70*b*. In the embodiment, the threshold value is set to, for example, T/2 where T is the time required for the agitating shaft 52 to make one complete rotation. As shown in FIG. 17A, when the remaining toner in the toner cartridge 17 is sufficient, the ON time of the sensor 15 does not exceed the threshold value. If the remaining toner in the toner cartridge 17 is little as shown in FIG. 17B, the second crank 52*b* abuts the tip portion of the flap 53 when the crank 52*b* reaches the position shown in FIG. 18A. When the second crank 52*b* reaches the position shown in FIG. 18C as the boss 54 rotates, the second crank 52*b* is at the position just before the second crank 52*b* leaves the flap 53. When the first crank 52*a* further rotates as the boss 54 rotates, the first crank 52*a* leaves the tip of the flap 53. Due to its own weight, as shown in FIG. 17B, the first crank 52*a* rotates toward the bottom dead center. At this moment, the second crank 52*b* moves toward the top dead center and causes the sensor 15 to become ON as shown in FIG. 18D. The first crank 52*a* waits at the bottom dead center until the boss 54 reaches the first crank 52*a*. When the boss 54 has reached the first crank 52*a*, the first crank 52*a* starts rotating again together with the boss 54. When the second crank 52*b* reaches the position shown in FIG. 18B, a part of the sensor lever 14 leaves the fine shaft 57. When one end of the sensor lever 14 leaves the second end of the fine shaft 57, the sensor 15 becomes OFF as shown in FIG. 18C. The CPU 70*a* causes the built-in timer to count the ON time of the sensor 15 for which the sensor 15 remains ON. The CPU 70*a* compares the ON time of the sensor 15 with the threshold value to check whether the ON time exceeds the threshold value.

The threshold value is stored in the memory 70*b*. In the present embodiment, the threshold value is set to, for example, T/2 where T is the time required for the agitating shaft 52 to make one complete rotation. If the ON time t of the sensor 15 exceeds the threshold value as shown in FIG. 18D, the CPU 70*a* reads a message that prompts replacement of the toner cartridge. Subsequently, the CPU 70*a* displays the message on the display 71. When the toner exerts a load on the fine shaft 57, the fine shaft 57 flexes while rotating. The fine shaft 57 resiliently flexes to absorb the force exerted by the toner. The fine shaft 57 flexes to prevent further increase in the load exerted on the agitating shaft 52. When the load on the agitating shaft is prevented from increasing, the drive force of the drive gear 68 is enough to drive the agitating shaft in rotation. Because the load is reduced, the agitating shaft 52 can agitate the toner. Since the toner is agitated, printing can be performed normally. Due to the fact that the fine shaft 57 flexes, the magnetic body 59 may not reach a position where the magnetic body 59 operates normally. When the magnetic body 59 does not reach the position where the magnetic body operates normally, an attraction force does not act between the magnetic body 59 and the permanent magnet 12. In this case, the sensor lever 14 does not move together with the permanent magnet 12. Because the sensor lever 14 does not move, the sensor 15 cannot detect the ON state. Thus, the remaining toner cannot be detected from the output signal of the sensor 15. However, the fine shaft 57 can move due to the toner-agitating operation. When the fine shaft 57 moves, the rod 57 interferes with lumps of toner and crushes the lumps. The fine shaft 57 bumps the lumps of toner a plurality of times to crush the lumps of toner. When the lumps of toner become extinct, the normal attraction force acts between the magnetic body 59 and the permanent magnet 12 so that the magnet 12 causes the sensor lever 14 to operate normally. When the sensor lever 14 operates, the sensor 15 detects the ON state, thereby allowing detecting of the remaining toner from the output signal of the sensor 15. The fine shaft 57 is made of a stainless steel (SUS304-WPB, longitudinal modulus of elasticity $E=1.9\times10^3$ kgf/mm$^2$, lateral modulus of elasticity $G=7\times10^3$ kgf/mm$^2$) having a diameter of 0.6 mm. The fine shaft 57 has a helical end that is curled around the second crank 52*b* of the agitating shaft 52. The fine shaft 57 is made of a stainless steel having a diameter of 0.6 mm for the following reasons.

The early density of sufficiently agitated toner in the toner cartridge is as follows: Y=0.345–0.385 (g/cm$^3$), M=0.345–0.385 (g/cm$^3$), C=0.335–0.375 (g/cm$^3$), B=0.350–0.390 (g/cm$^3$). Vibration is given to the toner to increase its apparent density by a factor of two. Then, by using the toner having an apparent density of toner substantially twice the normal toner density, an experiment was conducted to evaluate the ability of the fine shaft 57 to detect an amount of the remaining toner. The experiment was conducted for different diameters of the fine shaft 57 in the range of 0.2 to 1.0 mm, in increments of 0.1 mm. The results are as follows:

Diameters greater than 0.8 mm increases the rigidity of the fine shaft 57 and makes the rod 57 difficult to flex. Diameters greater than 0.8 mm provides the same results as the conventional art. Diameters greater than 0.8 mm exerts a large load on the bearing on which the agitating shaft rotates and the drive gear 68. Too large a load on the drive gear 68 prevents the toner from being agitated, so that the image forming section 5 cannot perform printing normally. Additionally, the image forming section fails to detect the remaining toner in the toner cartridge.

When the diameter of the fine shaft 57 is less than 0.4 mm, once the fine shaft 57 flexes, it cannot regain its original shape. When the diameter is less than 0.4 mm, even if the non-clumped density of toner is as good as initial value, the remaining toner sensor cannot be operated to become ON and OFF. When the diameter is less than 0.4 mm, detection of remaining toner of the fine shaft 57 malfunctions. If the deformed fine shaft 57 is operated, the fine shaft 57 may interfere with the surroundings. The image forming section 5 cannot perform the normal printing operation because the fine shaft 57 is exerted an increased load. Thus, the diameter of the fine shaft 57 is in the range of 0.4 to 0.8 mm and preferably 0.6 mm. The fine shaft 57 may not be made of stainless steel in its entirety but may be in part. In the first embodiment, a part of the fine shaft 57 is made of a material such that when the part receives pressures greater than a predetermined value, then the part absorbs the pressure. In particular, the fine shaft 57 should be made of flexible stainless steel having a diameter of 0.6 mm. The toner may clump in the toner cartridge due to vibration added from outside. However, the fine shaft 57 has a small diameter that allows the fine shaft 57 to flex to absorb the load of the toner. Therefore, the fine shaft 57 can operate normally even if the toner is clumped. The toner cartridge has an anti-rotation film 60*b* so that the first crank is sandwiched between the anti-rotation film 60*b* and the projection of the boss. The first crank is held between the projection and the anti-rotation film 60*b*. The anti-rotation film 60*b* has resiliency and is a thin plate of, for example, polyethylene terephthalate (PET) having a thickness of 0.1 mm. The anti-rotation film 60*b* extends along the first crank 52*a*. The anti-rotation film 60*b* has a height such that the anti-rotation film 60 extends at least across the rotational path of the first crank 52*a*. The forces exerted on the anti-rotation film 60 by the free motion of the agitating shaft 52 during transportation are much smaller than the force exerted on the anti-rotation film 60 by the drive source 69 during printing. Thus, the anti-rotation film 60 prevents the agitating shaft 52 from rotating during transportation.

Thus, the first crank is held at its bottom dead center even if vibration is added to the toner cartridge. When the first crank is fixed at its bottom dead center, the gap between the magnetic body and the film becomes small. The gap between the magnetic body and the film reduces the toner clumping if the first crank is fixed at its bottom dead center. When the agitating shaft 52 receives the drive force from the drive source 69 to rotate, the agitating shaft 52 pushes the anti-rotation film 60*b* so that the anti-rotation film 60*b* flexes. When the anti-rotation film 60*b* flexes, the agitating shaft 5 overrides the anti-rotation film 60 and rotates.

The thickness of the film attached to the upper wall of the guide is selected to be 0.2 mm. The stroke of the sensor lever 14 may be made longer and the threshold value of the sensor may have a large range. The film attached to the upper wall of the guide is colorless-and-transparent, or colorless-and-translucent. The toner color can be seen through the film. This eliminates the assembly step of bonding a label that identifies the color of toner.

Second Embodiment

Figure 19:
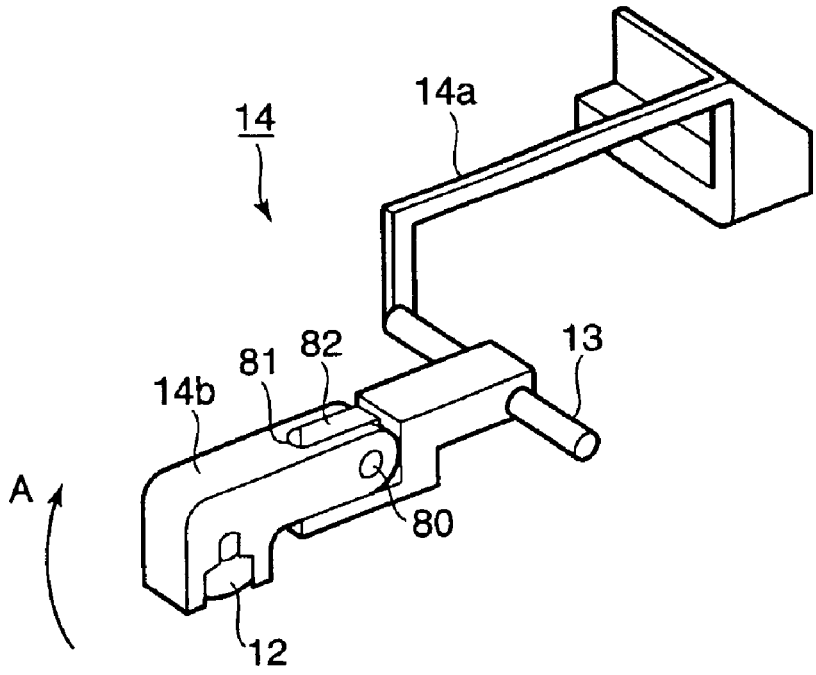
FIG. 19 is a perspective view of a sensor lever according to a second embodiment.

FIG. 19 is a perspective view of the sensor lever.

Figure 20:
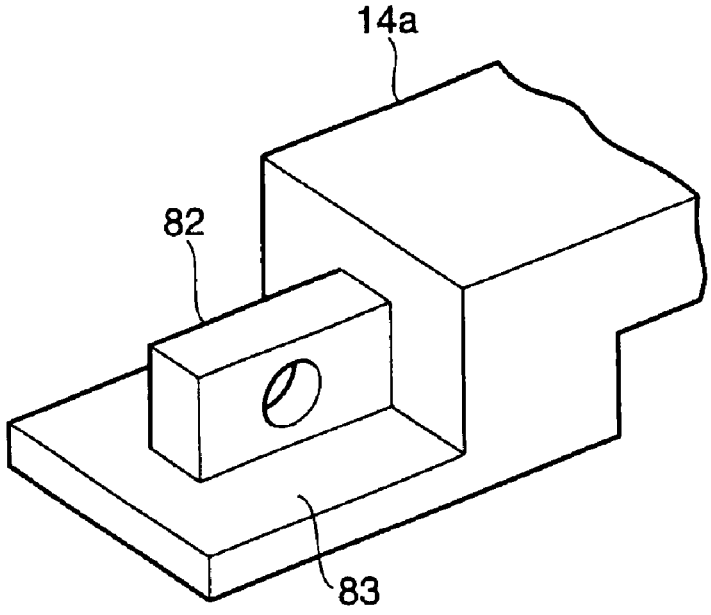
FIG. 20 illustrates a coupling portion of the lever in detail.

FIG. 20 illustrates the details of a coupling portion of a second lever.

A second embodiment differs from the first embodiment in that a second pivot shaft 80 is provided at one end of the sensor lever 14 so that the one end of the sensor lever 14 is pivotal about the pivot shaft 80. That is, the sensor lever 14 includes a first lever 14*a* and a second lever 14*b*. The first lever 14*a* and the second lever 14*b* are coupled through the pivot shaft 80. As shown in FIG. 20, the first lever 14*a* has a stepped portion 83 and a projection 82. As shown in FIG. 19, the second lever 14*b* has a groove 81 that fits the projection 82. A torsion spring, not shown, is mounted on the second pivot shaft 80 in such a way that end portions of the torsion spring abut the first lever 14*a* and the second lever 14*b*, respectively.

The operation will be described.

The operation of the second embodiment differs from that of the first embodiment in that the image forming section 5 in FIG. 2 can be moved up and down relative to the transport belt 4. For example, the image forming section 5 for black moves to the down position when printing is performed with black toner. The image forming section 5 for black is moved close to the transport belt 4. Image forming sections for yellow, magenta, and cyan are moved to the up position, away from the transport belt 4. For this reason, the gap between the toner cartridge and sensor lever should be determined taking in to account the up-and-down movement of the image forming section. In the second embodiment, when the image forming section is moved to the up position, the image forming section 5 abuts the second lever 14*b*. When the image forming section 5 abuts the second lever 14*b*, only the second lever 14*b* rotates about the pivot shaft 80 in the direction shown by arrow A (FIG. 19). In other words, the second lever 14*b* displaces with respect to the first lever 14*a* in such a direction as to move away from the image forming section 5. Thus, the gap between the toner cartridge and one end of the sensor lever 14 can be set only by taking the detecting operation of remaining toner in the toner cartridge. During the detection of remaining toner, the agitating shaft 52 rotates in the direction shown by arrows so that the second crank 52*b* approaches its top dead center and then leaves the top dead center repetitively. Every time the second crank 52*b* approaches the top dead center and then leaves the top dead center, an attraction force acts between the magnetic body 59 and the permanent magnet 12. The attraction force acts between the magnetic body 59 and the permanent magnet 12 through the film 60*a*. The permanent magnet 12 is fixed to one end of the sensor lever 14*b*. The sensor lever 14*b* and sensor lever 14*a* contact each other at the second pivot shaft 80 and operatively rotate about the pivot shaft 13. The sensor lever 14*a* makes the sensor 15 ON and OFF. According to the second embodiment, the second lever is rotatable with respect to the first lever, so that when the image forming section is moved to the down position, the first lever and second lever become ready to make the sensor ON and OFF. When the image forming section is moved to the position, the second lever moves beyond the range in which the first lever can move. Because the second lever can move beyond the range in which the first lever can move, the gap between the toner cartridge and one end of the sensor lever can be small. Because the gap between the toner cartridge and one end of the sensor lever can be small, the sensor lever can be miniaturized.

Third Embodiment

Figure 21:
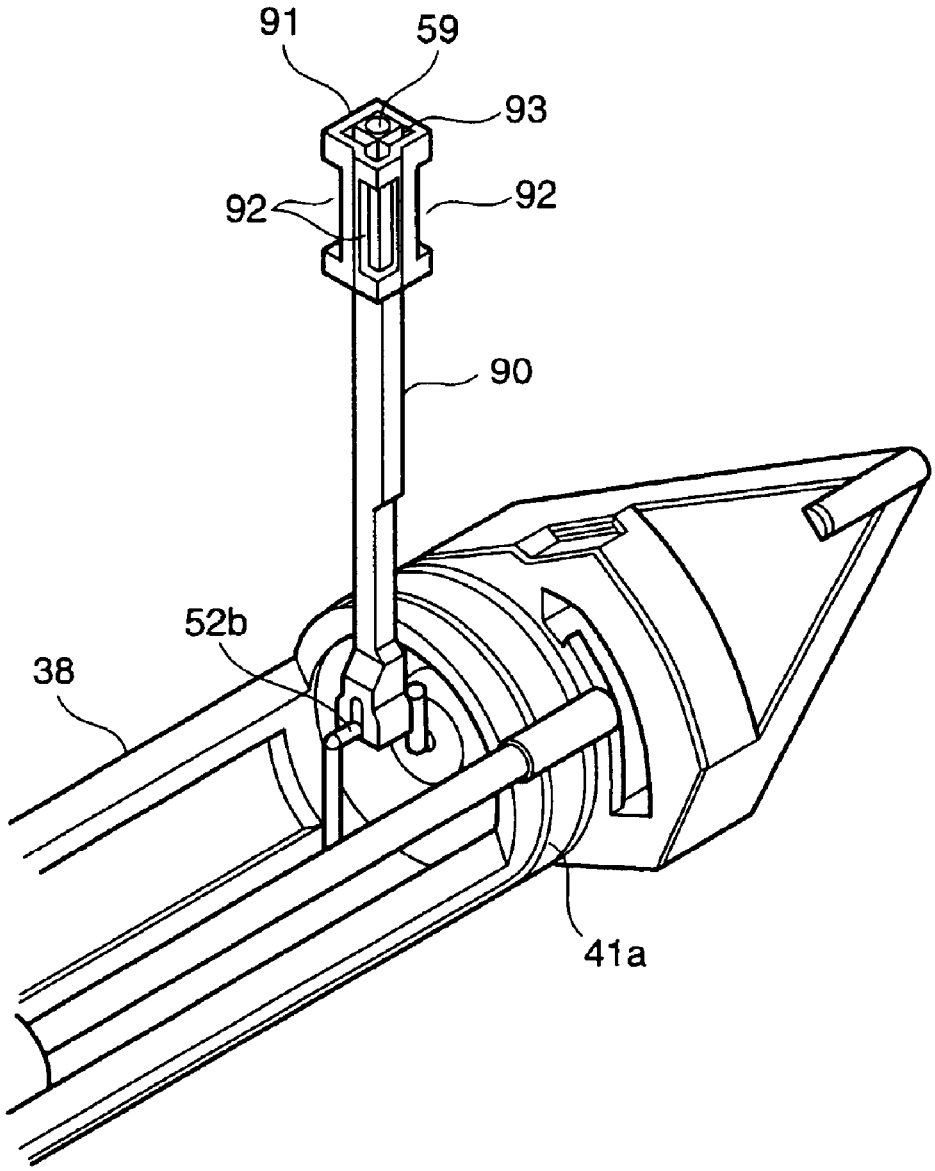
FIG. 21 is a perspective view of the fine shaft according to a third embodiment.

FIG. 21 is a perspective view of a sensor rod according to a third embodiment.

The third embodiment differs from the first embodiment in that the sensor rod 90 is made of plastics and has a rectangular cross section. The sensor rod 90 has a first end coupled to the second crank 52*b* and a second end fixed to magnetic body 59, the second end sliding in the guide 58 provided on the upper wall of the body case 28. The guide 58 has inner surfaces on which the magnetic body slides. The guide 58 form cavity portions around the magnetic body. The guide 58 is cut away in part at their corners to form holes 92 so that the cavity portions 93 communicate the outside air through the holes 92. Thus, the guide 58 has holes 92 at the four corners, thereby minimizing areas of the guide 58 in contact with the sensor rod 90. The sensor rod 90 has a minimum area in contact with the guide 91. The sensor rod 90 reduces friction load exerted on the sensor rod 90 during the operation for detecting the remaining toner. The sensor rod 90 allows the toner that entered among the magnetic body 59, guide 91, and film 60*a* to be discharged through the holes 92. The sensor rod 90 prevents the toner from being clumped among the magnetic body 59, guide 91, and film 60*a*. According to the third embodiment, cavity portions are provided between the guide and the magnetic body that is fixed to the sensor rod. The guide has holes formed in the surface on which the magnetic body slides, the holes communicating with the cavity portions. The holes that communicate with the cavity portions discharge the toner that enters the gap between the magnetic body and the upper wall of the guide due to, for example, vibration, thereby preventing toner from clumping. In addition, the holes in communication with the cavity portions serve to reduce a load on the sensor rod resulting from friction.

The present invention of the aforementioned configuration provides the following advantages. At least part of the sensor rod is made of a material that absorbs a pressure when the pressure is applied to the sensor rod. The toner in the toner cartridge becomes clumped due to vibration. Even if the clumped toner exerts a load on the sensor rod, the sensor rod absorbs the force. Then, the image forming section becomes ready to perform a printing operation.

What is claimed is:

1. A toner cartridge that supplies toner to a developing unit for forming a toner image, the toner cartridge comprising:

a chamber that holds the toner therein;

an agitator that rotates to agitate the toner in the chamber; and a reciprocally moving member that extends generally in a longitudinal direction and is operatively coupled to the agitator, wherein the agitator rotates relative to the reciprocally moving member to cause the reciprocally moving member to perform a reciprocating motion substantially in the longitudinal direction;

wherein at least a part of said reciprocally moving member is made of a material such that when the part receives a pressure greater than a predetermined value, the part absorbs the pressure.

2. The toner cartridge according to claim 1, wherein the part of said reciprocally moving member is in contact with the toner.

3. The toner cartridge according to claim 1, wherein said reciprocally moving member is a part of a remaining toner-detecting mechanism that detects an amount of toner remaining in said chamber.

4. The toner cartridge according to claim 3, wherein the remaining toner-detecting mechanism includes said agitator that agitates the toner in the toner cartridge;

wherein said reciprocally moving member has a first end rotatably engaging said agitator and a second end having a detector.

5. The toner cartridge according to claim 4, wherein the detector is made of a magnetic body.

6. The toner cartridge according to claim 4, wherein the detector is made of a permanent magnet.

7. The toner cartridge according to claim 4, wherein said remaining toner-detecting mechanism includes a guide formed on an inner wall of said chamber;

wherein the guide receives the second end of said reciprocally moving member in such a way that the second end can slide on the guide.

8. The toner cartridge according to claim 7, wherein the guide has a hole formed therein and a cavity portion is defined between the guide and the reciprocally moving member, the cavity portion communicating with the hole.

9. The toner cartridge according to claim 1, wherein said agitator includes a first crank and a second crank, the first crank agitating the toner in the toner chamber;

wherein the agitator is rotatably supported at its one end portion by a side wall of the toner chamber, and the second crank is coupled to the reciprocally moving member in such a way that the second crank is rotatable relative to the first end of the reciprocally moving member to cause said reciprocally moving member to perform the reciprocating motion.

10. The toner cartridge according to claim 1, wherein the material is a flexible material.

11. The toner cartridge according to claim 10, wherein the flexible material is a metal material.

12. The toner cartridge according to claim 11, wherein the reciprocally moving member has a diameter in the range of 0.4 to 0.8 mm.

13. An image forming apparatus to which a print process cartridge is attachable, the print process cartridge including a developing unit that forms a toner image, the image forming apparatus comprising:

a mounting section to which a the print process cartridge is removably attached, the print process cartridge removably holding a toner cartridge that has a toner chamber, an agitator that rotates to agitate toner in the toner chamber, and a reciprocally moving member that extends generally in a longitudinal direction and is operatively coupled to the agitator, wherein the agitator rotates relative to the reciprocally moving member to cause the reciprocally moving member to perform a reciprocating motion substantially in the longitudinal direction, and at least a part of the reciprocally moving member being made of a material that absorbs a pressure greater than a predetermined value; and a drive source that drives the agitator from outside of the toner cartridge.

14. The image forming apparatus according to claim 13, further comprising a sensor mechanism that detects the reciprocating motion of said reciprocally moving member to detect an amount of remaining toner in the toner chamber.

15. The image forming apparatus according to claim 14, wherein the reciprocally moving member has a first end that engages the agitator and a second end that is connected to a detection member.

16. The image forming apparatus according to claim 15, wherein the sensor mechanism includes a sensor lever that cooperates with the detection member in such a way that the sensor lever and the detection member attract each other and a sensor is switched between an ON state and an OFF state by the sensor lever.

17. The image forming apparatus according to claim 16, wherein the sensor lever includes;

a first lever pivotally supported on a first pivot shaft and having one end portion that causes the sensor to switch between the ON state and the OFF state; and a second lever pivotally coupled to another end of said first lever through a second pivot shaft, and attracting the detection member provided on the reciprocally moving member;

wherein when the second lever receives a force in an opposite direction to an attraction force of the detection member, the second lever pivots about the second pivot shaft relative to the first lever.

18. The image forming apparatus according to claim 16, wherein the sensor lever includes a first lever and a second lever;

wherein when the second lever receives a first force equal to or less than a certain value, the first lever and the second lever move together to cause the sensor to normally operate;

wherein when the second lever receives a second force greater than the certain value, the second lever displaces with respect to the first lever in such a direction as to move away from the second force.

19. A print process cartridge having a developing unit that forms a toner image, the print process cartridge comprising:

a mounting section to which a toner cartridge is removably attached, the toner cartridge removably having a toner chamber, an agitator that rotates to agitate toner in the toner chamber, and a reciprocally moving member that extends generally in a longitudinal direction, and is operatively coupled to the agitator, wherein the agitator rotates relative to the reciprocally moving member to cause the reciprocally moving member to perform a reciprocating motion substantially in the longitudinal direction, and at least a part of the reciprocally moving member being made of a material that absorbs a pressure greater than a predetermined value; and a drive force-transmitting section that transmits a drive force to the motion transmitting section.

20. A toner cartridge that supplies toner to a developing unit for forming a toner image, the toner cartridge comprising:

a chamber that holds the toner therein:

an agitator that rotates to agitate the toner in said chamber;

a reciprocally moving member that is operatively coupled to the agitator, wherein the agitator rotates relative to the reciprocally moving member to cause the reciprocally moving member to perform a reciprocating motion; and a guide member provided on an inner wall of said chamber and which receives one end of the reciprocally moving member so that said reciprocally moving member slidably moves in said guide member;

wherein at least a part of said reciprocally moving member is made of a material, such that when the part receives a pressure greater than a predetermined value, the part absorbs the pressure to yieldably resiliently deform so that said agitator continues to rotate.

* * * * *